United States Patent [19]

Sugden

[11] 4,381,038

[45] Apr. 26, 1983

[54] RAISE BIT WITH CUTTERS STEPPED IN A SPIRAL AND FLYWHEEL

[75] Inventor: David B. Sugden, Tasmania, Australia

[73] Assignee: The Robbins Company, Kent, Wash.

[21] Appl. No.: 208,999

[22] Filed: Nov. 21, 1980

[51] Int. Cl.[3] ..... E21B 10/10; E21B 10/12

[52] U.S. Cl. ..... 175/344; 175/53; 175/376; 175/325; 74/572

[58] Field of Search ..... 175/53, 56, 106, 319, 175/320, 344, 376; 299/14, 86, 90; 74/572

[56] References Cited

U.S. PATENT DOCUMENTS

| | | | |
|---|---|---|---|
| 1,391,626 | 9/1921 | Gilthorpe . | |
| 3,357,744 | 12/1967 | Heyer . | |
| 3,385,130 | 5/1968 | Boice | 74/572 |
| 3,805,901 | 4/1974 | Coski | 175/53 |
| 3,902,562 | 9/1975 | Pessier et al. | 175/344 X |
| 4,049,067 | 9/1977 | Dively | 175/53 X |
| 4,076,087 | 2/1978 | Chuply et al. . | |
| 4,142,593 | 3/1979 | Dixon et al. . | |

*Primary Examiner*—Ernest R. Purser
*Attorney, Agent, or Firm*—John O. Graybeal

[57] ABSTRACT

A bit connectible from the lower end of a rotatably powered drill stem for enlarging a preformed pilot hole includes a cutter carrier frame on which are mounted a plurality of roller cutters having peripheral cutting edges which sweep concentric circles upon rotation of the raise drilling bit. The circles swept by the cutters collectively define a generally dome-shaped cutting profile of constantly changing curvature which forms a segment of a spiral curve so that as the cutting profile extends radially outwardly from the drill stem, its curvature progressively decreases. The rotating cutter carrier frame structure drives a flywheel assembly at increased speed through the intermediacy of a step-up drive system composed of two planetary gear drives coupled in tandem. The flywheel assembly is mounted on the step-up drive in such a manner that if a sudden, large difference in acceleration occurs between the flywheel and the cutter carrier structure frame, the flywheel is free to continue to rotate to thereby prevent damage to the components of the step-up drive.

48 Claims, 13 Drawing Figures

RAISE BIT WITH CUTTERS STEPPED IN A SPIRAL AND FLYWHEEL

BACKGROUND OF THE INVENTION

1. Technical Field

The present invention relates to earth boring machines, and in particular to an improved bit for forming large-diameter raise holes.

2. Background Art

Vertical shafts between different levels of a mine are required to provide, for example, ventilation, access for rescue in emergency situations, and passageways for ore transfer and for water conduits and electricity lines. These shafts are commonly formed by first drilling a small diameter pilot hole downwardly from an upper mine level to a lower level with a small diameter pilot bit attached to the lower end of a drill string composed of sections of drill pipe. The drill string is rotated about its longitudinal axis by a drilling rig anchored to the floor at the upper mine level. Sections of drill pipe are added as the pilot bit progresses downwardly. Once the desired depth of the shaft is reached, the small diameter pilot bit is removed and replaced with a much larger diameter raise bit. The raise bit is rotated and simultaneously pulled upwardly along the pilot hole by the drilling rig through the intermediacy of the drill string to enlarge the pilot hole. As the raise bit is drawn upwardly, sections of the drill pipe are progressively removed.

Typically, the raise bit comprises a cutter carrier frame rigidly fixed to a drill stem which in turn is detachably connectible to the lower end of a drill string. A plurality of roller cutters are mounted on the upper surface of the cutter carrier frame to disintegrate the earth formations surrounding the pilot hole.

A major disadvantage of existing raise bits, especially those used to form larger diameter shafts, is that a large number of cutters are needed relative to the size of the shaft formed. This stems at least in part from the fact that raise bit cutters are normally positioned on a cutter carrier frame so that their cutting edges form a dome-shaped profile, with the larger the hole, the deeper the profile. This type of profile tends to laterally stabilize the raise bit so that it tracks the pilot hole. For a given diameter raise hole, however, the actual surface area swept by the cutters is larger for a deeper dome than for a more shallow one, and so the number of required cutters is larger for a deep dome. The additional cutters not only increase the initial expense of the raise bit, but also add to the cost of periodically dressing the cutters.

One problem caused by reducing the number of cutters on a bit designed to form a given size raise hole is that fewer cutters are available to prevent tilting of the bit, and high bending stresses are induced on the drill stem when a particular bit encounters a piece of especially hard or fracture resistant rock. Because the hard rock resists penetration by the cutter, the bit tends to tilt downwardly at that location. Reducing the number of cutters on the bit will result in fewer cutters being disposed on the opposite side of the bit to react against the working face of the raise hole to prevent tilting of the bit. Moreover, arranging the cutters in a rather shallow profile reduces the lateral stability of the raise bit also causing the bit to rock or tilt as it advances and thus less satisfactorily track the pilot hole.

Another problem with existing raise bits is that the cutters wear out at uneven rates. As soon as a cutter wears out, the cutterhead must be lowered to the bottom of the raise hole so that the cutter can be replaced, thus involving a time consuming, expensive operation.

During raise drilling operations, rock fractures sporadically under the tremendous loads imposed on the rock by the cutters. The sporadic fracturing of the rock in turn imparts constantly varying, resisting loads on the cutters. Thus, even though the drilling rig rotates the upper portion of the drill string at a uniform speed, the distally located raise bit usually rotates in a jerky, uneven manner, constantly accelerating and decelerating the raise bit and thereby causing high, cyclical stress peaks in the drill string possibly leading to failure of the string from fatigue. The jerky motion of the raise bit also not only reduces the efficiency of the cutters, but also causes abnormal cutter wear. The irratic motions of the raise bit is aggravated by the fact that the rotational inertia of the raise bit is very low relative to the loads imposed on the bit by the hard rock because of the typically slow speeds at which the bit is rotated, e.g. 10 to 20 revolutions per minute.

When the cutters abruptly encounter an extremely hard rock formation, the raise bit may actually stop rotating for a time while the torsionally elastic drill string "winds up" under the constant rotation of the drilling rig. It is not uncommon for the upper end portion of a drill string to rotate from 40 to 50 degrees beyond the angular position of the raise bit before enough torque is developed in the stem to overcome the resisting torque load applied to the bit by the rock formation. When the raise bit finally works free, all of the torsional energy stored in the long drill string is suddenly released thereby greatly accelerating or "whipping" the raise bit. Consequently, the raise bit overruns the drill stem thus winding up the drill string in the direction in advance of the rotation of the drilling rig. Because the rotational inertia of the raise bit has been depleted in winding up the drill stem in the advance direction, the torque available at the bit is actually less than normal, thus facilitating another jamming of the bit, thereby perpetuating the typically jerky rotational movement of the bit.

Furthermore, if sufficient windup of the drill string occurs, the raise bit may overrun the drill stem to such an extreme extent that the threaded drill string segments actually unscrew and can come apart. If this occurs, the raise bit and the portion of the drill stem still attached thereto will fall to the bottom of the shaft and be damaged, and probably beyond repair.

Known raise bit designs have not satisfactorily solved the reaming problems to which the invention is addressed. U.S. Pat. No. 4,142,593 discloses a raise drill bit incorporating an elastomeric element between the drive stem and the bit body on which the roller cutters are mounted. Although the elastomeric element may absorb some of the impact loads passing through the drill bit, it also permits the bit body to wind up relative to the drive stem thereby further aggravating the drill string windup problems discussed above.

To theoretically reduce the torque load required to enlarge a pilot hole, U.S. Pat. No. 4,076,087 utilizes a raise head having a smaller diameter, inner set of cutters which initially cuts an intermediate size raise hole and a trailing, outer set of cutters which forms the final diameter of the raise hole once the intermediate diameter raise has been formed by the inner cutters. The inner and outer set of cutters are adapted to shift relative to each other along the length of the drive stem so that they can form the raise hole in a stepwise manner. It can be appreciated that this stepwise reaming procedure, while perhaps requiring less maximum rotational torque to form a given diameter raise hole, is quite slow in operation since it requires two separate cutting operations to form a raise hole of a given diameter.

Another type of known, relevant drilling apparatus is disclosed by U.S. Pat. No. 1,391,626 wherein a flywheel is coupled to a drive shaft which connects an electric motor to a rotating cutterhead. Also, U.S. Pat. No. 3,357,744 discloses a coal planing device utilizing a flywheel to impart vibratory ramming movement to a series of chisel-like cutting tools.

DISCLOSURE OF INVENTION

The present invention relative to a novel rotary drill bit for enlarging a preformed pilot hole, which bit in basic form is characterized by a cutter carrier detachably connectible to the lower end of a rotatably powered sectioned drill stem extending downwardly through the pilot hole. The cutter carrier includes a frame structure formed generally in the shape of a hollow dome having a center hub for receiving the drill stem. A central cutter assembly is mounted on the top portion of the frame structure.

The cutter carrier also includes a plurality of intermediate roller cutters having peripheral cutting edge portions which project upwardly of the frame structure to sweep concentric circles about the longitudinal axis of the drill stem as the frame structure rotates. The intermediate roller cutters are arranged on the frame structure at locations outwardly of the central roller cutter so that the circles swept by their peripheral cutting edge portions collectively define a generally dome-shaped cutting profile in the form of a segment of a spiral. The profile curves radially outwardly and downwardly from the central roller cutters at a limited rate so that the angle separating the two adjacent chords, corresponding to any three adjacent cutting edge profile circles, progressively decreases as the radial distance between the intermediate cutters and the longitudinal axis of the drill stem increases.

To form the spiral segment-shaped cutting profile of the rotary drill bit, the intermediate roller cutters are not all disposed parallel to each other, rather they are oriented and correlated so that the axes about which the intermediate roller cutters rotate are tilted from the horizontal. The angles of tilt of the intermediate roller cutter axes progressively increase as the residual distances of the cutters from the drill stem increase, while the relative angle of tilt between the rotational axes of radially adjacent cutters decreases as the radial distance of the cutters from the drill stem increases. By tilting the axis of rotation of the intermediate cutters in this manner, each of the cutters is disposed geometrically normal to the adjacent portion of the cutting profile defined by the roller cutters.

By arranging the intermediate roller cutters in the manner described above, the distance in which each given cutter protrudes forwardly of the radially adjacent cutters on each of its sides decreases as the radial distance of the cutter from the drill stem increases. It is believed that the forces imposed on a cutter as it fractures the rock ahead and adjacent to it is proportional to the height which the cutter protrudes forwardly of the cutters on each side of it and thus cutter wear rate is also directly related to cutter protrusion. Accordingly, by virtue of the location of the intermediate cutters relative to the drill stem, the cutters located further away from the drill stem will tend to wear at a rate slower than the cutters located closer to the drill stem to thereby offset the increased rate at which the cutter wears as their distance from the drill stem increases due to the increased circumferential distance the cutters travel with each revolution of the drill stem. As a consequence, not only are the useful lives of the cutters prolonged, but also they all tend to wear out at approximately the same rate.

Also by limiting the increase in tilt of the intermediate roller cutters as their locatiion from the drill stem increases, the resulting cutting profile is relatively "flat" so that only a minimum number of cutters are required to form a raise hole of a given diameter. The shallow cutting profile also leads to the advantage that the roller cutters, especially those located near the gage region of the hole, are orientated more parallel or "square" to the upward direction traveled by the bit. As a consequence, a larger proportion of the thrust load applied to the raise head by the drill string is utilized by the cutters to fracture the rock at the working face than would be possible if the cutters were positioned in a more tilted orientation as in a cutterhead having a deep dome-shaped cutting profile.

In another aspect of the present invention, the rotary raise drill bit includes a plurality of large, elongate roller gage cutters each having multiple rows of cutting elements. The gage cutters are ideally diametrically opposed about the cutter frame structure at locations radially outwardly from the intermediate roller cutters. Each of the gage cutters has peripheral cutting edge portions which define a cutting profile corresponding to the profile defined by the cutting edge portions of the intermediate roller cutters. Utilizing the large gage cutters enables the raise head to not only rotate smoothly, but also track the pilot hole without excessively rocking or tilting back and forth even though the raise head is constructed with a minimum number of cutters arranged in a rather flat pattern.

Also, according to the present invention, the rotary drill bit includes a flywheel assembly coupled to the cutter carrier to serve as a torque reservoir to drive the cutter carrier at a uniform speed even if it suddenly encounters a large additional resisting load from, for instance, a section of fracture resistant rock. The flywheel assembly is driven by the cutter carrier at a rotational speed at least one order of magnitude faster than the speed of the cutter carrier frame structure through a step-up drive to thereby generate sufficient torque in the flywheel assembly to maintain the cutter carrier rotating at a substantially constant speed. As a consequence, the peak stresses in the drill string are minimized thus enabling a larger thrust load to be imparted on the cutter carrier for a given size diameter drill string. Also, the likelihood that the drill string will overrun the cutter carrier and cause decoupling of the drill string segments is reduced.

In another aspect of the present invention, the flywheel is connected to the step-up drive through an adjustable mounting structure which enables the flywheel to rotate relative to the step-up drive when a preselected difference in angular acceleration occurs between the cutter carrier and the flywheel assembly. Thus, if the cutter carrier suddenly accelerates or decelerates relative to the flywheel, the flywheel can continue to rotate at approximately its then current speed until the cutter carrier resumes its normal rotating speed.

BEST MODE OF CARRYING OUT THE INVENTION

Figure 1:
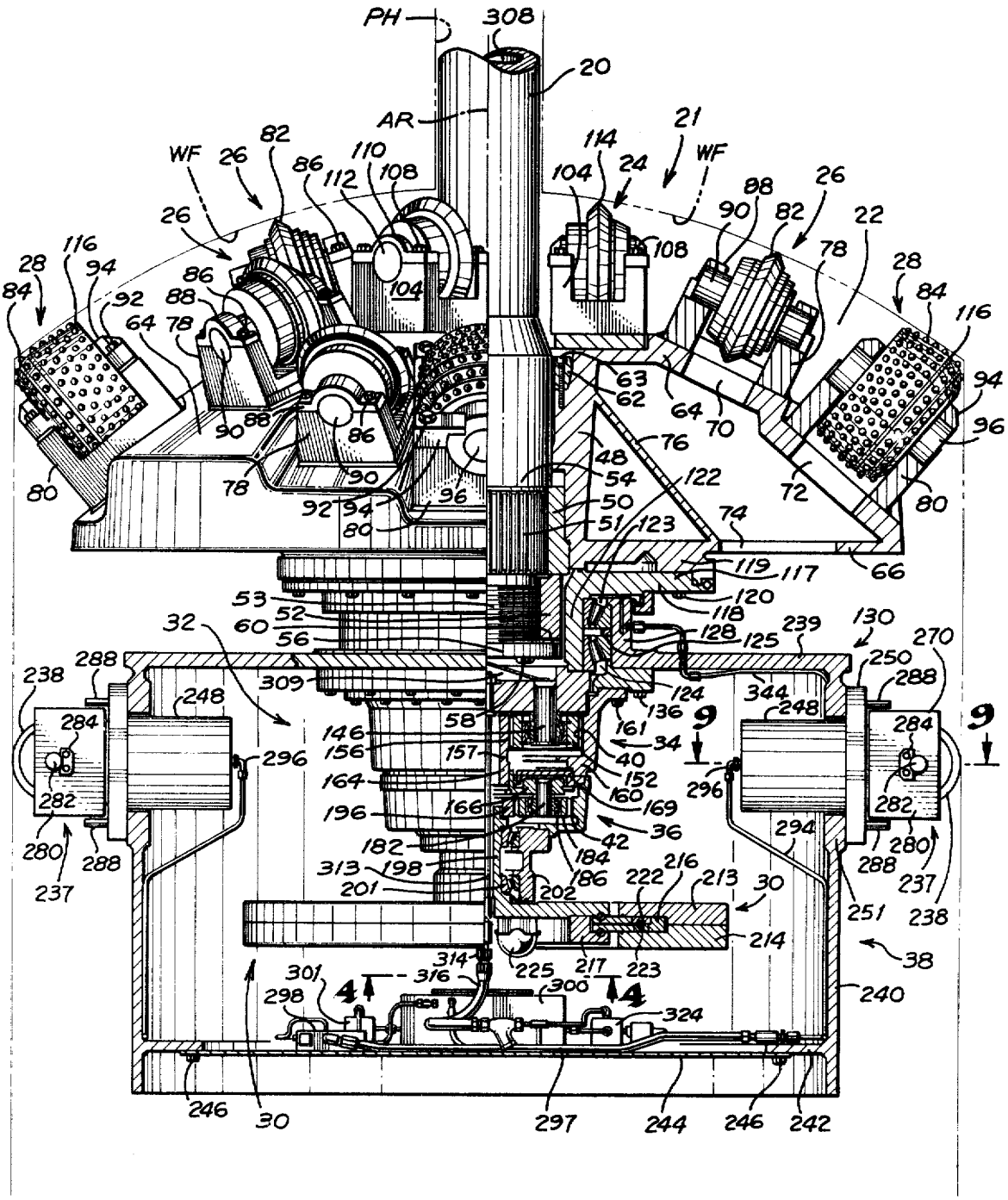
FIG. 1 is a side elevational view of one typical embodiment of a raise drill bit constructed according to the present invention, with portions shown in cross section.

Referring initially to FIG. 1, a raise drill bit 18 constructed according to the best mode of the present invention currently known to applicants is shown connected to the lower end portion of a rotary drill stem 20 attachable to the lower end of a drill string (not shown) which extends downwardly from a raise drilling machine (not shown) through a previously formed pilot hole PH. The raise bit 18 basically comprises a rotary cutter carrier 21 composed of a hollow frame structure 22 on which is mounted a plurality of central roller cutters 24 disposed adjacent to stem 20, a plurality of intermediate roller cutters 26 located outwardly of central cutters 24, and a plurality of gage cutters 28 positioned around the outer circumference of frame structure 22. Raise bit 18 also includes a flywheel assembly 30 which is disposed below cutter carrier 22 through the intermediacy of step-up drive 32 to rotate about the longitudinal axis of drill stem 20 at a rotational speed significantly faster than the rotational speed of cutter carrier 21. Step-up drive 32 includes a secondary and primary planetary gear drive 34 and 36, respectively, which are connected in tandem between cutter carrier 21 and flywheel assembly 30. A stabilizer unit 38, which is journaled concentrically with cutter carrier 21, is anti-rotationally connected to the ring gears 40 and 42 of planetary gear drives 34 and 36 to thereby transmit the reaction torque generated by step-up drive 32 to the wall of large diameter raise hole RH formed by bit 18.

Figure 2:
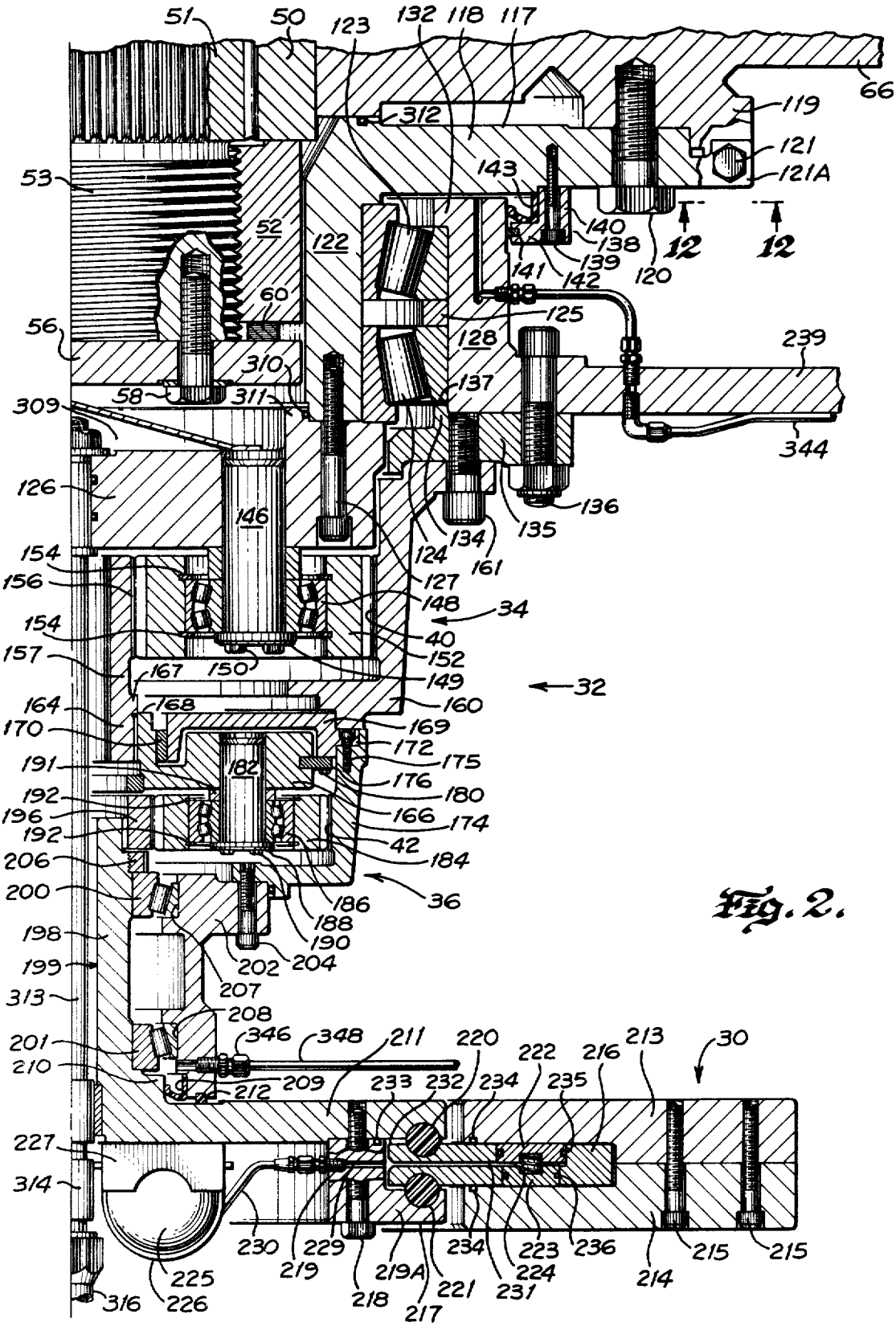
FIG. 2 is an enlarged, fragmentary cross-sectional view of a portion of the raise drill bit of the present invention illustrated in FIG. 1, specifically showing the construction of the flywheel assembly and the flywheel stepup drive.

The basic components of the typical embodiment of the present invention set forth above are next described with greater specificity. Referring specifically to FIGS. 1 and 2, drill stem 20 extends downwardly through a central bore provided in hub section 48 of frame structure 22 to engage with a splined insert 50 affixed, such as by weldments, within an enlarged counterbore formed in the lower end portion of hub section 48. Alternatively, insert 50 can be integrally formed with hub section 48. The engagement of the splined portion 51 of drill stem 20 with splined insert 50 insures that cutter carrier 21 and the drill stem are anti-rotationally connected together. Furthermore, cutter carrier 21 and drill stem 20 are prevented from sliding longitudinally relative to each other by large nut 52 which engages with the stem threaded lower end portion 53 which in turn extends downwardly below splined insert 50. Nut 52 loads splined insert 50 upwardly against a shoulder 54 formed in drill stem 20 just above splined portion 51. Nut 52 is securely interlocked with drill stem 20 by a flat, circularly shaped keeper plate 56 which is held in abutting relationship with the bottom end of said drill stem 20 by a plurality of capscrews 58 extending through clearance holes provided in the keeper plate and engaging with aligned, vertical, tapped holes formed in the threaded lower end portion 53 of drill stem 20. Nut 52 and keeper plate 56 are loaded relative to each other by annularly shaped shims 60 which engage over the outer circumference of the threaded lower end of drill stem 20 at a location between the lower end of nut 52 and the upper surface of keeper plate 56.

In addition to the use of drill stem spline 51 and insert 50, cutter carrier 21 is radially located relative to stem 20 by a segmented wedge ring 62 which extends downwardly into a tapered counterbore formed in the upper end portion of cutter carrier hub section 48. Capscrews 63 extend downwardly through counter-sunk clearance holes provided in each segment of wedge ring 62 to screw into a corresponding aligned, vertical, tapped hole provided in the upper end portion of hub section 48 to thereby lock the vertical inside diameter of said wedge ring 62 against the vertical outside diameter of drill stem 20 and the tapered outside diameter of the said wedge ring against the correspondingly sloped counterbore diameter of hub section 48. Rather than being constructed in a single, annularly shaped member, wedge ring 62 is formed in a plurality of segments so that that the ring can be conveniently assembled with and disassembled from hub section 48 without having to be slipped over the entire length of drill stem 20. It will be recognized that wedge ring 62 provides a contact location spaced upwardly from spline 51 against which cutter carrier 21 can bear to thereby enable stem 20 and carrier 21 to carry any radial loads acting therebetween during the operation of raise bit 18.

Next, referring specifically to FIGS. 1 and 2, frame structure 22 further includes a truncated, downwardly open, generally domed shaped outer shell 64 which forms the mounting surface for intermediate and gage roller cutters 26 and 28, respectively. The center of shell 64 surrounds hub section 48 which extends downwardly from the shell to intersect with a circularly shaped floor plate section 66. The outer circumference of floor plate 66 intersects the bottom rim of shell 64 to thereby complete the hollow form of frame structure 22. This particular construction of frame structure 22 insures that it has sufficient structural strength to withstand the extreme operational loads imparted on it, while still being light enough to be readily transported to a job site and conveniently assembled with drill stem 20.

Figure 6:
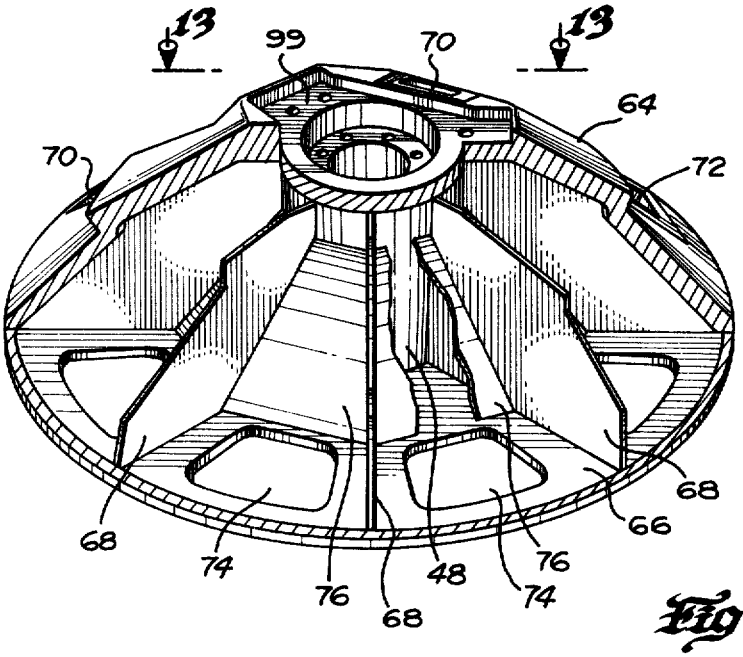
FIG. 6 is a fragmentary isometric view of the cutter carrier frame structure of the typical embodiment of the present invention illustrated in FIG. 1, with portions broken away to show interior construction of the frame structure.

As most clearly shown in FIG. 6, frame structure 22 also includes a plurality of divider plates 68 spaced around, and extending radially outwardly from, the outer circumference of hub section 48 to intersect with the underside of shell 64 and the upper surface of floor plate section 66, thereby dividing the cavity formed by the interior of shell 64 and floor plate section 66 into individual pie-shaped compartments. As best shown in FIGS. 1 and 6, shell 64 has an opening 70 at the location of each intermediate cutter 26 and a similar opening 72 at the location of each gage cutter 28 to permit earth materials fractured by these cutters to pass conveniently downwardly therethrough. Correspondingly, a series of generally rectangularly shaped openings 74 are provided in the outer circumference portions of floor plate 66 to allow the ground cuttings to drop downwardly away from cutter carrier 21.

Referring to FIGS. 1 and 6, frame structure 22 further includes triangularly shaped deflector plates 76 each disposed between adjacent divider plates 68 to extend downwardly and radially outwardly from the upper portion of hub section 48 in sloped array to intersect with the upper surface of floor plate sections 66 at a location slightly radially inwardly of floor plate openings 74. Cut earth materials, which drop downwardly through carrier shell openings 70, initially fall onto deflector plates 76 and then slide downwardly therealong to finally pass out through floor plate openings 74. This particular construction enables the fractured material to quickly fall away from intermediate and gage cutters 26 and 28, respectively, so that the cutters do not become clogged by the falling material.

As best shown in FIG. 1, the marginal area immediately surrounding intermediate roller cutter openings 70 and gage roller cutter openings 72 is flattened or recessed beneath the nominal upper surface of shell 64 to form pads for intermediate roller cutter housings 78 and gage cutter housings 80, which housings are generally U-shaped and preferably welded to said carrier shell 64. Roller cutter housings 78 and 80 form cutter compartments or cells for rotatably mounting cutters 24 and 26, respectively, therein so that the peripheral cutting edges 82 of intermediate cutters 24 and peripheral cutting edges 84 of gage cutters 28 extend upwardly above their corresponding housings to cut concentric kerfs in the working face WF of raise hole RH as the cutters sweep concentric circles during rotation of cutter carrier 21.

Intermediate roller cutters 26 are bolted to their corresponding housing 78 by capscrews 86 which extend through clearance holes provided in a yoke 88 journaled over the outer end portions of each intermediate roller support shaft 90 to engage within aligned tapped holes provided in the cutter housing. Likewise, gage cutters 28 are held in place by capscrews 92 which extend through clearance holes provided in retaining blocks 94 provided at each end of cutter support shaft 96 and then engage within aligned tapped holes provided in gage cutter housings 80.

Figure 13:
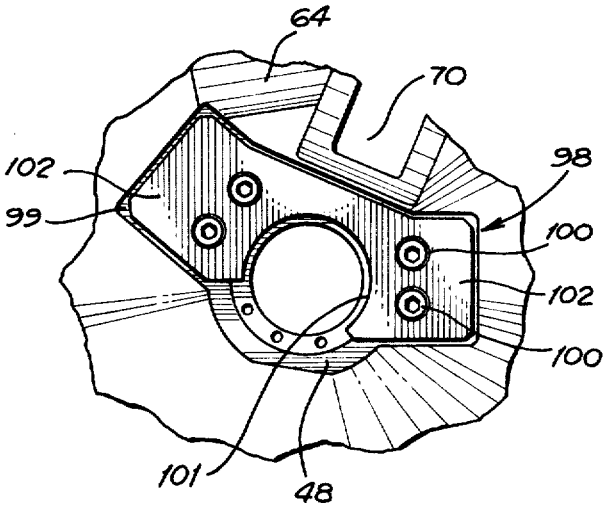
FIG. 13 is a fragmentary top view of the central portion of the cutter carrier frame structure shown in FIG. 6 taken along lines 13—13 thereof and specifically illustrating the central cutter mounting plate bolted in place but with the cutters themselves removed.

Central cutters 24 are not directly secured to cutter carrier shell 64, but rather are mounted on a separate mounting plate 98 so that they are located closer to drill stem 20 than would be possible if they were mounted directly on the cutter carrier shell. As best shown in FIGS. 6 and 13, mounting plate 98 sets within a recess 99 formed in shell 66 which surrounds the drill stem opening of hub section 48. Mounting plate 98 is detachably connected to the upper end of hub section 48 by a plurality of capscrews 100 which extend downwardly through the mounting plate to engage into aligned, circumferentially arranged tapped holes provided in the upper end portion of the hub section 48. A central opening 101 of a diameter large enough to clear drill stem 20 is provided in mounting plate 98. As most clearly illustrated in FIG. 13, mounting plate 98 includes two ear portions 102 which extend radially outwardly beyond the outside diameter of hub section 48 to form support surfaces for central roller cutter housings 104.

Central roller cutter housings 104 are preferably attached to mounting plate 98 by weldments with central roller cutters 24 themselves being bolted within corresponding housings 104 by capscrews 108 which extend downwardly through retention collars 110 provided at each end portion of a support shaft 112 to engage into aligned tapped holes provided in the housings 104. As with intermediate and gage cutters 26 and 28, respectively, central cutters 24 also form concentric kerfs in the working face WF of the raise hole as they sweep concentric circles upon rotation of cutter carrier 21.

Figure 7:
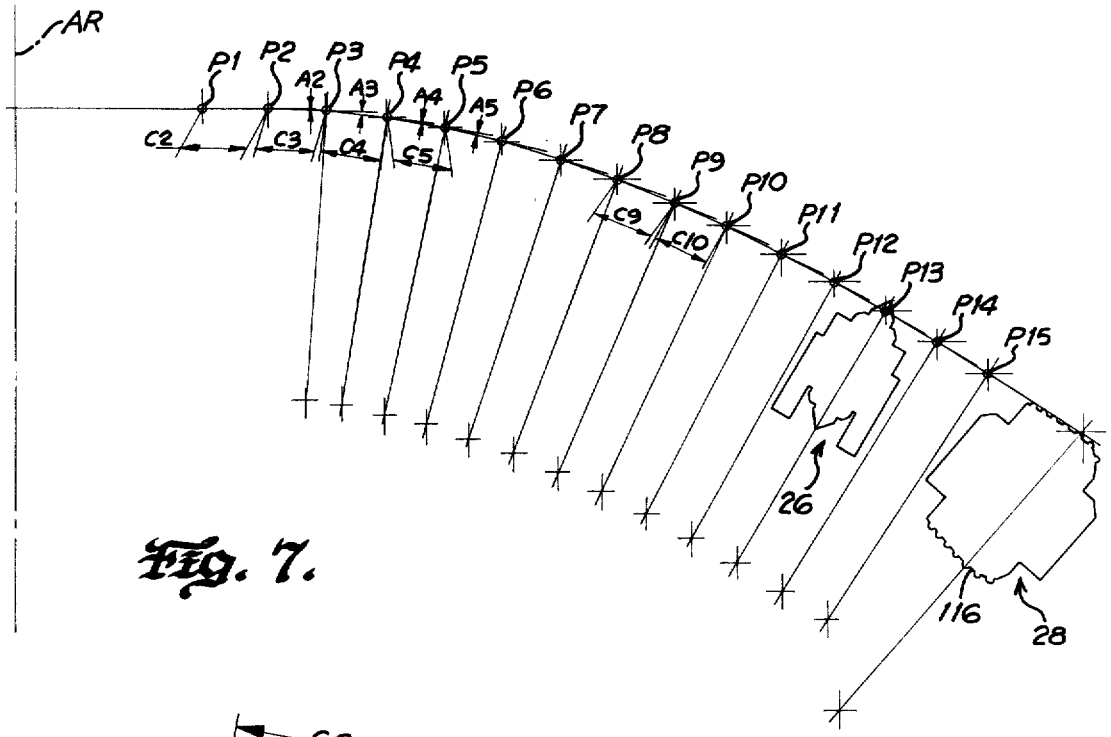
FIG. 7 is a schematic view illustrating in profile the relative angular orientation and radial location of each of the cutters utilized in the typical raise drill bit illustrated in FIG. 1.
Figure 8:
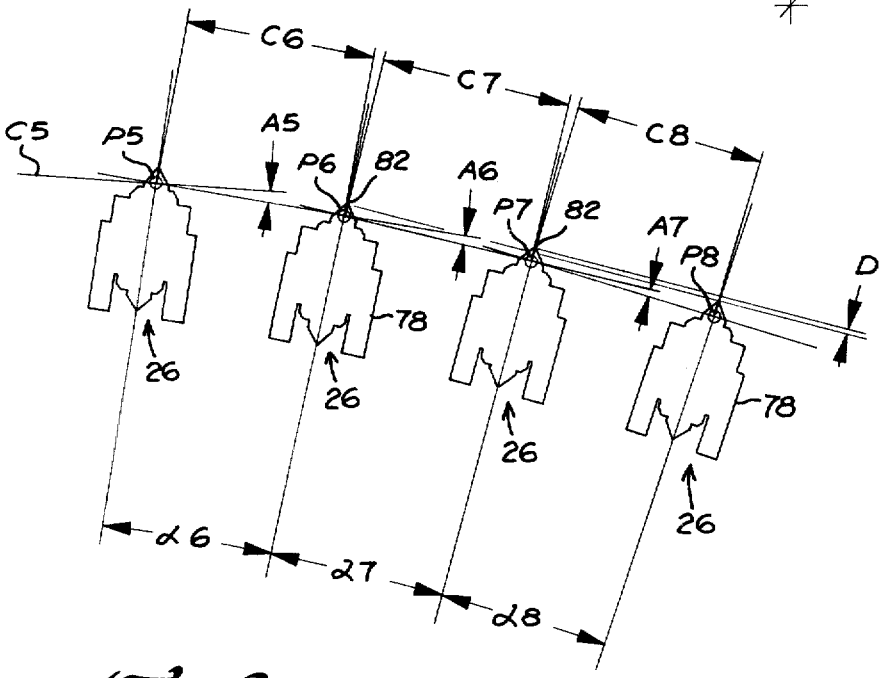
FIG. 8 is an enlarged schematic view of four of the cutters illustrated in FIG. 7.

Central cutters 24, intermediate cutters 26 and gage cutters 28 are positioned relative to each other on frame structure 22 to cooperatively define a concave, downwardly open, cutting profile at the working face WF of the raise hole RH. This profile is depicted in FIGS. 7 and 8 which illustrate the radial location and orientation of the cutters relative to each other. Of course the cutters are not all positioned in radial alignment, but are dispersed about shell 64 in the manner illustrated in FIGS. 1 and 5. In a preferred form of the present invention the central portion of the cutting profile is formed by two center cutters 24 which are labeled in FIGS. 5 and 7 as cutter Nos. 1 and 2. Central cutters 24 are mounted on frame structure 22 to rotate about an axis extending generally perpendicularly to the axis of rotation of drill stem 20 so that when the bit of the present invention is used to ream a vertical raise hole RH, the circles swept by the peripheral cutting edges 114 of the central cutters define a horizontal cutting profile.

Still referring to FIGS. 7 and 8, thirteen intermediate cutters 26, labeled as cutter Numbers 3 through 15, are positioned on cutter carrier shell 64 to sweep concentric circles which collectively form a dome-shaped cutting profile in the nature of a segment of a spiral curve which constantly decreases in curvature as the cutting profile extends radially further away from drill stem 20. During each rotation of cutter carrier 21, the peripheral cutting edges 82 of cutters 26, cut circular kerfs in the working face WF of raise hole RH. Cutters 26 are positioned relative to each other so that the relative angular orientation between any two adjacent intermediate roller cutters 26 diminishes as the radial distance between cutters 26 and the longitudinal axis of stem 20 increases even though individually the axis of rotation of the cutters are increasingly tilted from a horizontal orientation as their distance from drill stem 20 increases. For example, the relative angular orientation A5 between cutter Numbers 5 and 6 is greater than the relative tilt A6 between cutters Numbers 6 and 7 which in turn is greater than the relative tilt A7 between cutters Numbers 7 and 8. However the axis of rotation of cutter No. 8 is tilted from the horizontal more than the axis of rotation of cutters No. 7 which in turn is tilted more than cutter No. 6.

Regarding positioning cutters 26 on shell 64, the radially most inwardly disposed intermediate cutter, cutter No. 3, is located and angularly oriented relative to the outermost central cutter 24, cutter No. 2, by extending a chord C3 of a length L through the point P2 defined by the peripheral cutting edge 114 of cutter No. 2 radially outwardly and downwardly at an initial angle A3 from the horizontal line formed by extending the chord C2 connecting the outer peripheral cutting edges 114 of the two central roller cutters 24, cutter Nos. 1 and 2. The orientation of chord C3 as thusly established, also determines the angular orientation or tilt of the axis of rotation of cutter No. 3.

The second radially innermost located intermediate roller cutter 26, cutter No. 4, is angularly and radially outwardly positioned relative to the radially innermost located intermediate cutter 26, cutter No. 3, by extending a chord C4 of a length L radially outwardly and downwardly from the point P3 defined by the peripheral cutting edge 82 of cutter No. 3 at an angle A4 from the orientation of chord C3. Angle A4 is smaller than angle A3 with the actual reduction in the size of angle A4 relative to A3 dependent in part on the composition of the rock being drilled through and the diametrical size of the raise bit. Angle A4 could possibly be from one (1) to forty (40) percent less than angle A3. As a typical but nonlimiting example, angle A4 is illustrated as being ninety (90) percent of angle A3. The angle A4 separating chords C3 and C4 establishes the relative angular orientation between the axes about which roller cutters Nos. 3 and 4 rotate.

In accord with the above-described relative positional relationship between adjacent intermediate roller cutters, cutters Nos. 3 and 4, the third radially innermost located intermediate roller cutter, cutter No. 5, is elevationally positioned and angularly oriented relative to its next adjacent radially inwardly located intermediate roller cutter, cutter No. 4, by extending a chord C5 of a length L radially outwardly and downwardly at an angle A5 from the point P4 defined by the peripheral cutting edge 82 of cutter No. 4. Angle A5 is smaller than angle A4. Although not necessarily required, angle A5 can be the same proportion of angle A4 which angle A4 is of angle A3.

The position and angular orientation of the remaining intermediate roller cutters 26, cutters Nos. 6–15, follow this above-described relationship. It will be appreciated that the profile generated by the circles swept by the peripheral cutting edges 82 of intermediate cutters 26, cutter Nos. 3–15, is in the form of a concave, downwardly open, spiral segment on each side of drill stem 20, which profile decreases in curvature as the radial distance separating intermediate cutters 26 from drill stem 20 increases. This profile is established by radially separating adjacent intermediate cutters 26 by a chord length L while angularly orienting such chords C relative to each other so that the angle separating any two adjacent chords C is less than the angle separating the radially innermost located of said two chords C and the next radially inwardly located chord C.

In other words, the angle A separating any two adjacent chords defined by a set of any three adjacent intermediate cutters 26 progressively decreases as the distance of cutters 26 from the rotational axis of cutter carrier 21 increases. The rate of decrease of angle A can vary with the radial location of cutters 26 or the rate of decrease can be made constant or even linearly constant depending on factors such as the diameter of raise bit 18, the number of cutters 26 utilized and the composition of the rock being drilled through. If a constant rate of decrease is used, the angle separating any two adjacent chords will be a certain proportion of the angle separating the radially innermost located chord of the particular pair and the chord located next radially inwardly adjacent the pair.

By locating intermediate cutters 26 relative to each other in the manner described above, the protrusion into working face WF by a cutter 26 relative to the cutters located radially on each side of it decreases as the radial location of the cutters from drill stem 20 increases. The protrusion of a particular intermediate cutter 26 is equal to the distance D that the peripheral cutting edge 82 of the particular cutter 26 extends forwardly of a chorded line extending between the circles swept by the peripheral cutting edges 82 of the cutters located on each side of the particular cutter 26, FIG. 8. Since, as discussed above, the curvature of the envelope defined by the peripheral cutting edges 82 of intermediate roller cutters 26 decreases in the direction extending radially outwardly from the rotational axis of frame structure 22, it can be appreciated that the protrusion of intermediate cutters 26 decreases as the location of a particular cutter 26 from such axis of rotation increases.

Moreover, because applicant has found that the rate at which a roller cutter wears is proportional to the protrusion of that particular cutter, based on the amount of protrusion alone, intermediate roller cutters 26 should wear at a decreasing rate as their radial location from stem 20 increases. On the other hand, the linear distance that an intermediate cutter 26 travels with each revolution of cutter carrier 22 increases as its radial location from stem 20 increases. Since it is generally true that cutter wear is proportional to its linear distance of travel, the rate of wear of intermediate cutters 26 increases as the radial distance of the cutter 26 from the rotational center of frame assembly 22 increases. Thus, it can be appreciated that the wear rate of intermediate cutters 16 can be made substantially equal by progressively decreasing the protrusion, and thus the wear rate, of intermediate cutters 26 as their relative radial location from stem 20 increases to offset the increased wear rate of the cutters occurring by virtue of the increased linear distance they travel. Positioning cutters 26 relative to each other on frame structure 22 to wear at approximately the same rate maximizes the length of the raise hole RH which bit 18 can ream before intermediate cutters 16 must be dressed or replaced. Consequently, a raise reaming bit constructed according to the present invention is capable of reaming a raise hole at a rate faster than, and at a cost less than, is presently possible with conventional raise drill bits.

It will be recognized that the number and size of intermediate cutters 26 can be altered without departing from the essential features of the present invention which includes positioning the cutters on a cutter carrier so that the protrusion of a particular cutter ahead of the cutters on each side of it decreases as the location of the cutters from drive stem 20 increases. The above discussed advantages of locating cutters 26 in this manner will exist whether the cutters are mounted on cutter carrier designed to enlarge a preformed pilot hole or bore the full diameter of a blind hole.

It is to be further noted that by decreasing the curvature of the cutting profile of cutters 26 in the radial direction to emulate the profile of a segment of a spiral, a relatively "flat" overall cutting profile is formed. This "flat" profile not only enables fewer cutters to be used, but also enables the cutters to more "squarely" face the upward direction of travel of cutter carrier 21 than if a "deeper" cutting profile were used. Orientating cutters 26 in this manner enables them to cut more efficiently since more of the thrust load on the cutter is aligned with the plane defined by the cutting edge of the cutter.

It will be further noted that although all of the chords C3–C15 are illustrated in FIGS. 7 and 8 as being of the same length, this is not required. The important factor is that the curvature of the cutting profile of cutters 26 decreases in the radially outwardly direction so that a rather "flat" profile is achieved and so that the protrusion of cutters 26 decreases in the radially outwardly direction. It may in fact be advantageous to decrease the chordal spacing between adjacent cutters 26 as their location from stem 20 increases to thereby compensate for the corresponding reduction in penetration of the cutters.

Figure 5:
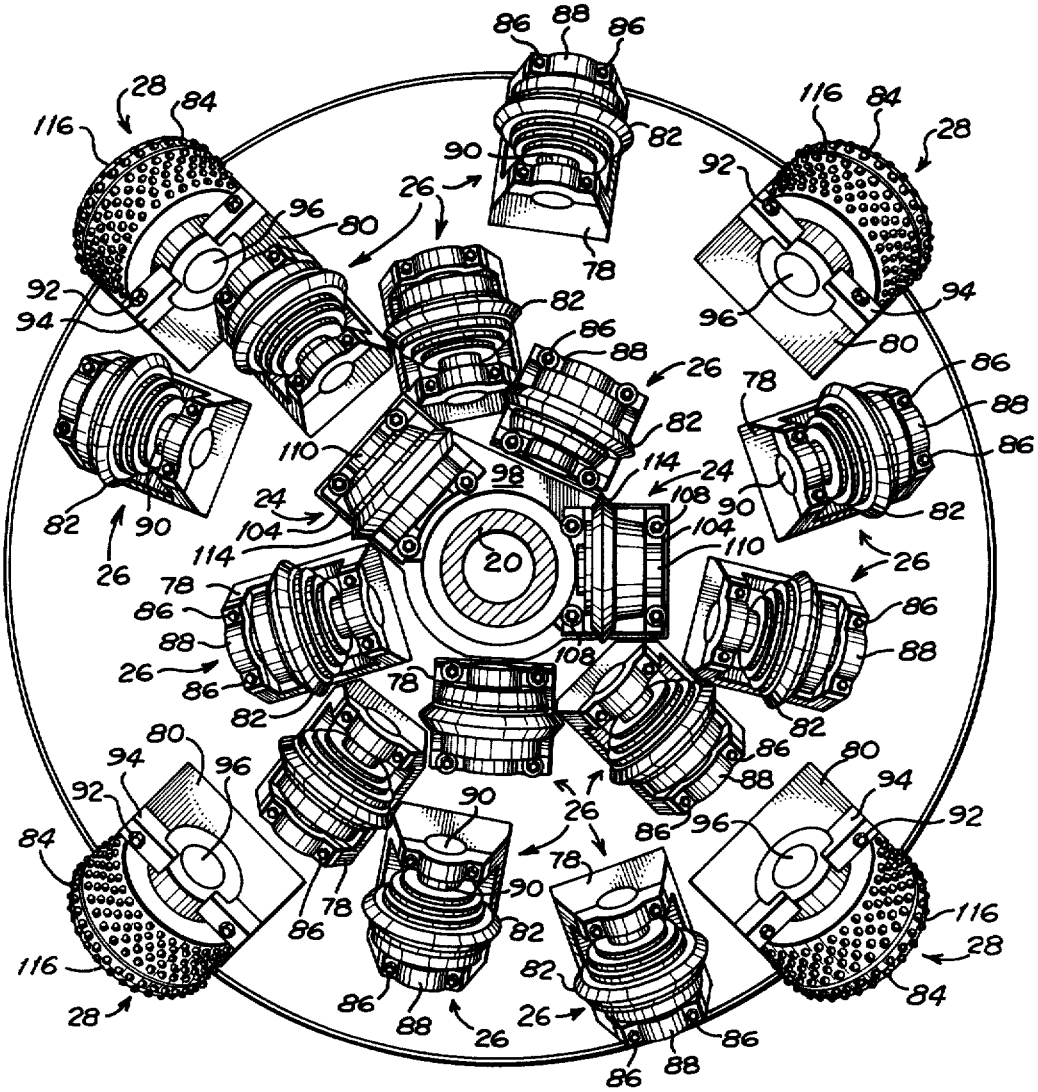
FIG. 5 is a top view of the typical embodiment of the present invention illustrated in FIG. 1 showing the arrangement of the roller cutters thereof mounted on the cutter carrier frame structure.

Next referring to FIGS. 5 and 7, four gage roller cutters 28 are mounted within housings 80 which are positioned in diametrically opposed relationship about the outer circumference of a carrier shell 64 to form the outer diameter of raise hole RH. Each gage cutter 28 includes an elongate, generally frustroconically shaped roller 116. A plurality of carbide cutting tips 84 extend a short distance radially outwardly from the outer surface of the roller 116 to cut concentric kerfs in the working face WF of raise hole RH as cutter carrier 21 rotates. Gage cutters 28 are positioned on carrier shell 64 such that their carbide cutting tips 82 generate a profile which generally corresponds to the profile defined by intermediate cutters 26. As such, the profile defined by gage cutters 28 at least initially extends tangentially to the profile formed by intermediate cutters 26 before curving downwardly to form the outer diameter of the raise hole.

Relative to intermediate disc cutters 26, cutters 28 together provide a very large surface area to address the raise hole working face WF. Typically a raise boring bit tends to rock or tilt upwardly about an axis perpendicular to the length of the drill stem due to voids in the working face caused by the sporadic fracture of the rock. Also, the raise bit is often forced to tilt downwardly as it rolls over chunks of rock held between the top of the raise bit and the working face. Tilting of the raise bit imparts a bending load on the drill stem and can cause the stem to fail if overstressed. Also, when the raise bit tilts or rocks, the cutters are often forced to assume a new path. As a result the cutters must impart additional energy to the rock to promulgate new cracks therein. If instead, the cutters continue along their previous paths, they are capable of efficiently cutting away rock which was cracked or fractured by a previous pass of the cutter.

It will be appreciated that because of their large cutter surface area, cutters 28 serve as a bearing pad to react against the tendency of raise reaming bit 18 to tilt. Moreover, even if a large tilting load is imparted to raise bit 18, the particular gage cutter 28 affected thereby will only engage into working face WF to the depth corresponding to the rather shallow height of carbide cutting tips 84, whereupon the outer surface of roller 116 will press against working face WF to prevent any further tilting of bit 18. As a consequence, constructing a raise bit 18 with roller gage cutters 28 results in a smoother more stable cutting action than in conventional raise bit designs.

Because cutting tips 84 only protrude a short distance above the surface of rollers 116, each cutter 28 only disintegrates a limited thickness of rock at working face WF. Consequently, all four roller cutters are positioned to travel in the same path, so that collectively they are capable of removing rock as fast as intermediate disc cutters 26. Moreover, positioning gage cutters 28 around the circumference of carrier shell 64 tends to distribute the thrust load imparted by stem 20 about the shell. Because of the large size and extreme outward location of gage cutters 28 relative to intermediate cutters 26, the diametrically opposed spacing of cutters 28 substantially minimizes any tendency of cutter carrier 21 to tilt relative to stem 20, thus minimizing bending stresses in the stem.

Although four gage roller cutters are utilized in the specific embodiment of the present invention illustrated in FIGS. 5 and 7, it is to be understood that other numbers of cutters may be employed.

Figure 12:
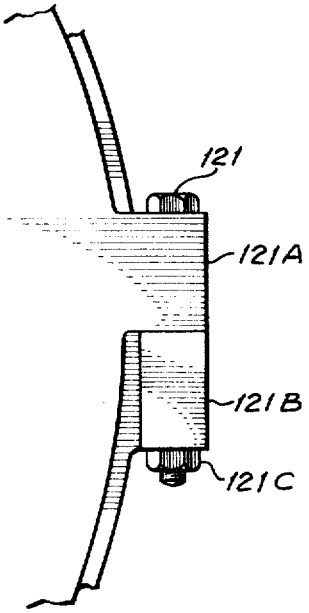
FIG. 12 is a greatly enlarged, fragmentary, bottom view of a portion of the step-up drive assembly illustrated in FIG. 2, taken substantially along lines 12—12 thereof.

Next, referring to the construction of step-up drive 32 which drives flywheel assembly 30, as shown in FIGS. 1 and 2, the horizontal flange portion 117 of a connecting ring 118, formed in a hub or L-shaped cross section, is bolted by a plurality of capscrews 120 upwardly to the underside of an attachment ring portion 119 of frame structure 22. Ring portion 119 extends downwardly from the underside of cutter carrier floor plate 66. As illustrated in FIGS. 2 and 12 connecting ring 118 is additionally secured to frame assembly 22 by capscrews 121 which extend through an apertured, horizontally disposed lug 121A integrally formed, and extending radially outwardly from, the outer circumference of flange portion 117 to extend through an aligned opening formed within a corresponding lug 121B extending outwardly from the outer circumference or attachment ring portion 119, to engage with nut 121C. This supplementary manner of bolting connecting ring 118 to frame structure 22 virtually eliminates any relative rotation therebetween, which rotation would likely cause capscrews 120 to either fatigue or shear off. Because of the large relative loading acting between cutter carrier 21 and step-up drive 32, capscrews 120 by themselves might not be able to prevent relative rotation between connecting ring 118 and frame structure 22.

The vertical center portion 122 of connecting ring 118, which encircles nut 52 and the lower end portion of drill stem 20, serves as a retainer for the inner races of a pair of tapered roller bearings 123 and 124 which are vertically spaced apart by a spacer ring 125. Bearings 123 and 124 anti-frictionally journal stabilizer unit 38 to frame structure 22. A thick, circular plate 126 is bolted upwardly against the bottom edge of connecting ring center portion 122 by capscrews to thereby vertically support the inner races of bearing 123 and 124.

The outer races of bearing 123 and 124 are retained by the central hub portion 128 of a generally cylindrically shaped stabilizer frame 130. Hub portion 128 has an integral uppe shoulder 132 which abuts against the upper edge of the outer race of upper bearing 123 to thereby prevent stabilizer frame 130 from dropping downwardly relative to connecting ring 118. Also, stabilizer frame 130 is prevented from rising upwardly relative to connecting ring 118 by an upwardly protruding rim portion 134 of an annularly shaped adapter plate 135 which is bolted to the underside of stabilizer frame central hub portion 128 by nut and bolt assemblies 136. Rim portion 134 bears upwardly against the lower edge of the outer race of lower bearing 124. Shims 137 are sandwiched between rim portion 134 and the outer race of lower bearing 124 and are of a thickness to apply the correct preload to the bearings.

As best shown in FIG. 2, a seal retaining ring 138 formed in an L-shaped cross section surrounds stabilizer frame central hub portion 128 and is bolted to the underside of connecting ring horizontal flange portion 117 by capscrews 139 which extend upwardly through the vertical leg portion 140 of the retaining ring. A wiper seal 141 is retained with a radially inwardly open groove formed within the circumferential edge portion of the horizontal leg portion 142 of retaining ring 138. Seal 141 wipes against the adjacent outer diameter of stabilizer frame central hub portion 128. A lip seal 143 is retained by a seat formed by the radially inwardly directed surface of vertical leg 140 and the upwardly directed surface of horizontal leg 142 of ring 138. Lip seal 143 also wipes against the hub portion 128 of stabilizer frame 130. Seals 141 and 143 cooperate to prevent fractured earth material and other foreign matter from contaminating bearings 123 and 124.

Again referring specifically to FIG. 2, secondary planetary gear drive 34 includes a plurality of pinion shafts 146 which extend downwardly from bearing retainer plate 126. A roller bearing 148 is retained on the lower end portion of each shaft 146 by cap plate 149 which is bolted to the free end of each shaft 146 by capscrews 150. Each bearing 148 antifrictionally supports a pinion gear 152 through the intermediacy of a pair of retaining rings 154 which are spaced above and below bearing 148 to snugly engage within grooves formed within gears 152. Pinion gears 152 mesh with the upper gear 156 of double sun gear 157 and a ring gear 40. Ring gear 40 is integrally formed with the inside surface of secondary planetary gear drive housing 160 which is bolted to the underside of adapter plate 135 by capscrews 161.

Still referring specifically to FIG. 2, double sun gear 157 has a hollow interior and a lower gear 164 which meshes with the pinion carrier 166 of primary planetary gear drive 36. Double sun gear 157 is longitudinally constrained by a central shoulder portion 167 which bottoms on the upper end 168 of pinion carrier 166. Pinion carrier 166 is antifrictionally journaled to a pinion carrier support structure 169 by radial bearing 170 disposed between the radially inward vertical leg of the pinion carrier support structure and the adjacent vertical surface of pinion carrier 166. Pinion carrier support structure 169, which is formed generally to form a downwardly open, U-shaped cross section, has an outer rim portion 172 which is sandwiched between the bottom edge of secondary planetary gear drive housing 160 and the abutting top edge of primary planetary gear drive housing 174 by a series of capscrews 175. A carrier thrust ring 176 is bolted upwardly against the bottom edge of the outer, vertical rim portion 178 of pinion carrier support structure 169 by capscrews 180. Carrier thrust ring 176 extends radially inwardly to engage within a corresponding groove provided in the outer circumference of primary pinion carrier 166 to thereby vertically support the pinion carrier.

A plurality of pinion shafts 182 depend downwardly from pinion carrier 166 to each antifrictionally support a pinion gear 184 through the intermediary of a spherical bearing 186. The inner race of bearing 186 snugly engages over the lower end pinion shaft 182 and is retained on shaft 182 by a retaining cap 188 which is bolted to the lower end of the shaft by bolts 190. A spacer 191 is interposed between the lower surface of pinion carrier 166 and the upper surface of the inner race of bearing 186 to maintain these two components virtually spaced apart. Each bearing 186 vertically supports its corresponding pinion gear 184 through the use of snap rings 192 which abut the bottom and top faces of the outer raise of the bearing and also extend within correspondingly shaped grooves provided in the inside diameter portion of each pinion gear.

Still referring to FIG. 2, pinion gears 184 mesh with ring gear 42 which is integrally formed with the inside surface of primary planetary gear drive housing 174 and also mesh with sun gear 196 which is affixed to the upper end portion of the hollow, elongate, vertically disposed drive shaft 198 of a flywheel drive hub 199. Spaced apart upper and lower bearings 200 and 201, respectively, antifrictionally journal driveshaft section 198 to a drive shaft support collar 202 which in turn is bolted upwardly to the lower end of primary gear drive housing 174 by a series of capscrews 204. Bearings 200 and 201 are preloaded by nut 206 which is disposed above the inner race of upper bearing 200 to engage with a corresponding threaded portion of drive shaft section 198. Drive shaft section 198 is vertically supported by bearing 200, the inner race of which bears upwardly against the lower surface nut 206 and the outer race of which seats with a counterbore 207 formed in the upper end portion collar 202, and by bearing 201, the inner face of which bears downwardly against a shoulder 210 formed in drive shaft section 198 and the outer race of which seats within a lower counterbore 208 formed in support collar 202. A lip seal 209 is pressed within an outer counterbore formed in the lower end portion of support collar 202 to wipe against the outer diameter of drive shaft section shoulder 210. As perhaps best illustrated in FIG. 2, flywheel drive hub 199 also includes a generally annularly shaped drive plate section 211 which is integrally formed with the lower end of drive shaft section 198 at a location closely beneath support collar 202. A wiper seal 212, which is snugly received within a correspondingly shaped, downwardly open groove formed in the bottom end portion of support collar 202, wipes against the adjacent upper surface of drive plate section 211.

Flywheel assembly 30, as best shown in FIG. 2, is constructed from two substantially identical, annularly shaped plates 213 and 214 having an inside diameter slightly larger than the outside diameter of hub drive plate 211. Plates 213 and 214 are bolted together in face-to-face relationship by capscrews 215 which extend through clearance holes provided in lower flywheel plate 214 and engaged with aligned threaded holes provided in upper flywheel plate 213. A shallow counterbore is formed in the lower side of upper flywheel plate 213 and the upper side of lower flywheel plate 214 so that, when the plates are bolted together, they define a radially inwardly open groove for receiving flywheel mounting disc 216. When flywheel upper and lower plates 213 and 214 are clamped together, they closely overlap the upper and lower faces, respectively, of mounting disc 216 while still permitting relative rotation between the disc and flywheel assembly 30. Mounting disc 216 is vertically supported by an angle-shaped clamping ring 217 which is bolted to the underside of drive plate section 211 by a plurality of socket head capscrews 218 which extend upwardly through clearance holes provided in the ring vertical leg portion 219 to engage within aligned, threaded holes, provided in drive plate section 211. Mounting disc 216 is clamped between the lower, marginal surface of drive plate section 211 and the upper surface of the ring horizontal leg portion 219A to thereby vertically constrain disc 216. A pair of rings 220 and 221, formed from elastomeric or similar material, are interposed between the lower surface of drive plate section 211 and the upper surface of mounting disc 216, and between the lower surface of mounting disc 216 and the upper surface of clamping ring horizontal leg 219A. Elastomeric rings 220 and 221 engage within arcuate grooves formed in drive plate section 211, the upper and lower surfaces of mounting disc 216 and clamping ring horizontal leg 219A so that when clamping ring 217 is secured to drive plate section 211, elastomeric rings 220 and 221 antirotationally clamp the mounting disc to these two components. It will be appreciated that elastomeric rings 220 and 221 absorb relative rotational and angular vibration and shock loads occurring between flywheel assembly 30 and step-up drive 32.

Because of nonuniformity in the geological composition of rock material, and other factors, raise bits, such as drill bit 18, tend to rotate in a nonuniform, and even jerky manner thus creating torsional stress peaks in stem 20 and in the drill string. Moreover, typically raise reaming cutterheads commonly tilt from side to side about an axes extending perpendicularly to the length of the bit drive stem thereby causing high bending stresses in stem 20. On the other hand, a large mass rotating at a high speed, such as flywheel 30 when driven by step-up drive 32, tends to continue rotating at its same speed and same orientation. Consequently, flywheel 30 assembly will actually drive step-up drive 32 and cutter carrier 21 when raise bit 18 would otherwise tend to momentarily decrease in rotational speed, such as when encountering discontinuity, in the rock structure. Thus, it will be appreciated that flywheel assembly 30 assists in maintaining raise bit 18 rotating at a uniform speed which not only improves the ability of cutters 24, 26, 28 to efficiently fracture the rock, but also minimizes the level of alternating torsional and bending stresses encountered by the drive stem. As a result, drill stem and drill pipe of a given size are capable of carrying a larger thrust load than in a cutterhead not utilizing flywheel 30.

It will be further recognized that elastomeric rings 220 and 221 serve to absorb vibration and shock loads occurring between flywheel 30 and step-up drive 32 due to the erratic rotational and angular motion of cutter carrier 21 and step-up drive 32 in comparison to the uniform rotation of flywheel assembly 30. However, if the rotational speed of raise bit 18 were suddenly very drastically reduced or increased, the large rotating mass of flywheel assembly 30 would likely overstress the components of step-up drive 32. To protect against this occurrence, sets of opposed pistons 222 and 223 are housed within flywheel mounting disc 216 to press against adjacent surfaces of flywheel plates 213 and 214, respectively, to nominally lock flywheel assembly 30 to disc 216 while permitting relative rotation between these two members when a predetermined difference in angular acceleration or torque load occurs between them. As most clearly illustrated in FIGS. 1 and 2, pistons 222 and 223 engage within close fitting bores formed in mounting disc 216, and are biased in opposite directions away from each other into nominal engagement against flywheel plates 213 and 214 by a compression spring 224 housed within aligned central blind bores formed in the two pistons.

Figure 4:
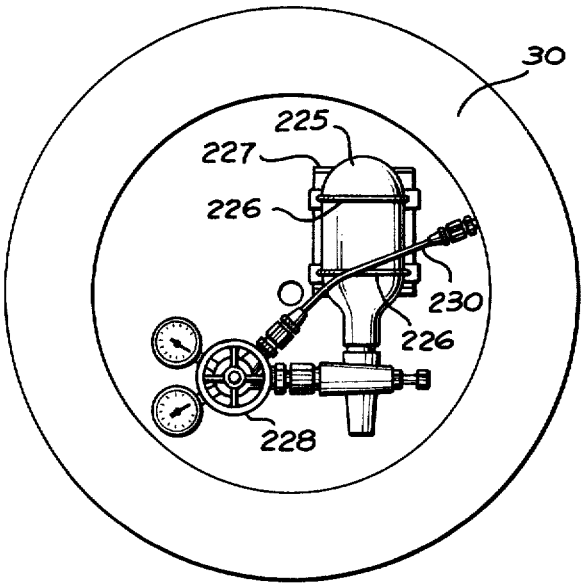
FIG. 4 is an enlarged, fragmentary bottom view of the present invention illustrated in FIG. 1, taken along lines 4—4 thereof, specifically showing the flywheel fluid charging system.

Although springs 224 in fact load pistons 222 and 223 against flywheel plates 213 and 214, the pistons are much more highly loaded by pressurized charging fluid, preferably nitrogen gas, stored within a pressure vessel 225 secured to the underside of drive hub plate section 211 by a pair of U-shaped clamps 226 extending downwardly from a mounting bracket 227 fixedly attached to plate 211 by any convenient means, for instance by welding, FIGS. 2 and 4. Pressure vessel 225 is fitted with a regulator 228 which in turn is connected in fluid flow communication with a bore 229 extending radially through vertical leg 219 of clamping ring 217 by hose assembly 230. As most clearly illustrated in FIG. 2, clamping ring bore 229 is in fluid flow communication with a plurality of fluid delivery passageways 231 extending radially outwardly from the inner edge of mounting disc 216 through the body of the disc to the bores which house pistons 222 and 223. A cavity or fluid inlet manifold 232 is formed by clamping ring 217, the lower surface of drive hub plate section 211 and the radially inwardly edge portion of mounting disc 216. Manifold 232 is sealed to prevent fluid from escaping therefrom by elastomeric rings 220 and 221 and by O-ring 232 seated within a groove formed in the upper surface portion of clamping ring 217 to seal against the lower surface of drive hub plate section 211. The charging fluid is sealed against escaping between flywheel assembly 30 and mounting disc 216 by a pair of O-rings 234 which seat within circularly extending grooves formed in the lower surface of flywheel upper plate 213 and the upper surface of flywheel lower plate 214 at a radial location adjacent the inward edge portions of the flywheel plates. Each piston 222 and 223 is also fitted with a corresponding O-ring 235 and 236, respectively, which seat within radially outwardly open grooves formed in the circumference of the pistons to seal against the walls of the corresponding piston bores.

It will be recognized that utilizing pressurized charging fluid stored within vessel 225 enables a precise load to be exerted on pistons 222 and 223 so that they nominally frictionally lock flywheel assembly 30 with mounting disc 216 while permitting relative rotation therebetween when a predetermined difference in torque exists between these two components. The pressure of the charging fluid required to load pistons 222 and 223 to the desired level can be accurately calculated and then easily achieved by simply adjusting regulator 228. Thus, no trial and error procedures are required to accurately load pistons 222 and 223, which perhaps would be necessary if such pistons were loaded by other method, such as by springs.

Figure 9:
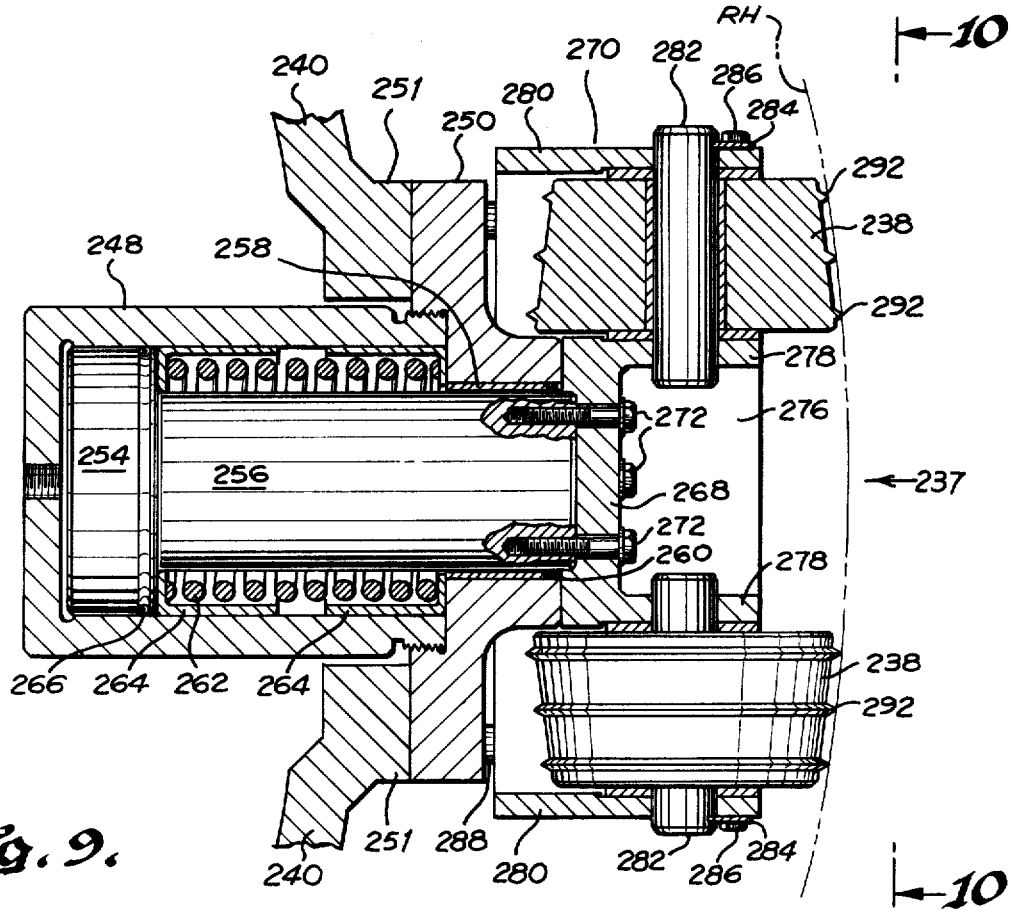
FIG. 9 is an enlarged, fragmentary, cross-sectional view of the fluid rams carried by the stabilizer frame illustrated in FIG. 1, taken substantially along lines 9—9 thereof.
Figure 10:
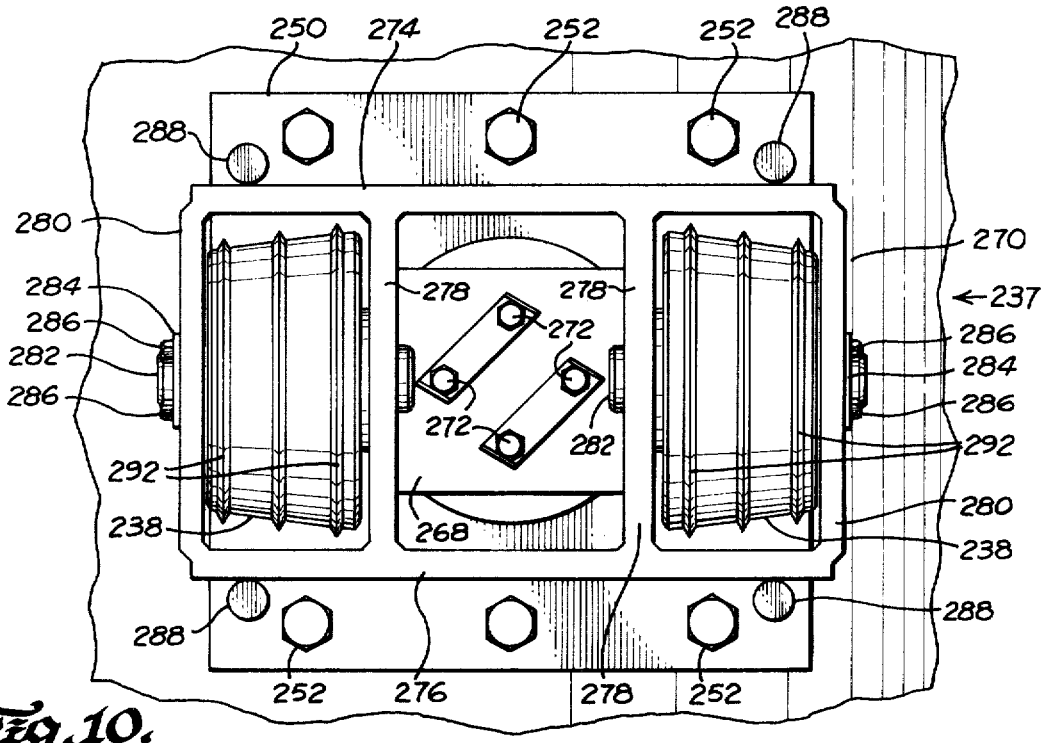
FIG. 10 is an end view of the typical fluid ram illustrated in FIG. 9, taken along lines 10—10 thereof.

Now referring to FIGS. 1, 9 and 10, stabilizer unit 38 is illustrated as basically composed of a generally cylindrically shaped frame 130 which is rotatably journaled relative to cutter carrier 21 by bearings 123 and 124, as described above. Stabilizer frame 130 supports a plurality of fluid ram assemblies 237 radially outwardly relative to the rotational axis of cutter carrier 21. When energized, each hydraulic ram assembly 237 in turn pushes a pair of normally retracted reaction rollers 238 outwardly against the wall of the raise hole. More specifically, stabilizer frame 130 is constructed from a cylindrically shaped hub portion 128 which also serves as the retainer for the outer race of bearings 123 and 124. The stabilizer frame also includes an upper, horizontally disposed annularly shaped wall or cover 239 which surrounds the lower end of hub portion 128. A cylindrically shaped vertical wall 240 extends downwardly from the outer circumferential portion of cover 239 to an elevation below hydraulic ram assemblies 237 and flywheel assembly 30. A ledge 242 extends a short distance radially inwardly from the inside wall of a lower edge portion of wall 240 a distance sufficient to define a circular opening providing access to flywheel assembly 30 and step-up drive 32. A circularly shaped bottom cover plate 244 is bolted upwardly against the underside of ledge 242 by a series of capscrews 246 extending upwardly through clearance holes formed about the circumference of the cover plate to engage into aligned threaded holes formed in ledge 242.

As illustrated in FIGS. 9 and 10, each fluid ram assembly 237 is constructed from a horizontally disposed cylinder 248 which is radially positioned relative to the axis of rotation of cutter carrier 21 by a mounting flange 250 having a threaded counter bore for receiving the externally threaded, open end portion of cylinder 248. Flange 250 is in turn fixedly attached by capscrews 252 to the outside surface of a flat boss 251 integrally formed with frame vertical wall 240. Each boss 251 is provided with a central clearance hole through which a corresponding cylinder 248 extends.

Each cylinder 248 slidably houses a closely fitting piston 254 which in turn supports a piston rod 256 that extends outwardly from cylinder 248 through a close fitting central opening provided in mounting flange 250 in a direction radially of the axis of rotation of cutter carrier 21. A neck bushing 258 is pressed within the central opening of mounting flange 250 to closely and slidably encircle piston rod 256 to thereby guide and support the piston rod. A rod wiper seal 260 is also pressed within the mounting flange opening to bottom against the end of bushing 258 opposite piston 254 to wipe against the circumference of piston rod 256. Piston rod 256 is normally biased into a retracted position by compression spring 262 which surrounds the portion of the rod disposed with cylinder 248. Each end of compression spring 262 bottoms on the base or lip portion of cup-shaped spring guides 264 which are slidably housed within cylinder 248. The cylindrical sleeve portions of spring guides 264 abut together when rod 256 is extended to thereby function as a stop to limit the travel of piston 254. A seal 266 is disposed within a groove formed within the outer circumference of piston 254 at a location adjacent spring guide 264 to prevent leakage of pressurized fluid, preferably hydraulic fluid, located at the opposite side of said piston 254.

Referring to FIGS. 9 and 10, the free end of piston rod 256 extends within a blind shallow counterbore formed in a central mounting plate 268 of a roller support frame 270 and is maintained therein by a plurality of capscrews 272. Roller support frame 270 also includes flat, horizontally disposed bottom and top plates 274 and 276, respectively, which are spaced vertically apart in parallel relationship by a pair of central vertical connecting plates 278 and a pair of distal, vertical, end connecting plates 280. Central connecting plates 278 are fixedly attached to central mounting plate 268, for instance by welding.

A pair of tapered reaction rollers 238 are rotatably axled between central connecting plate 278 and their corresponding end connecting plates 280 by a horizontally disposed shaft 282 which extends through aligned openings provided in the connecting plates. Each shaft 282 is axially constrained by a keeper plate 284 which is receivable within a close fitting, correspondingly shaped groove provided in the adjacent portion of the circumference of shaft 282 facing the keeper plate. Keeper plate 284 is in turn fixed to the outer surface of a corresponding end connecting plate 280 by a pair of capscrews 286 which extend through clearance holes provided in the keeper plate to engage within an aligned tapped hole provided in the end connecting plate. Piston 254 is prevented from rotating within cylinder 248 so that shafts 282 are maintained in horizontal orientation by two pairs of horizontally spaced apart guide pins 288 which extend outwardly from each cylinder mounting flange 250 to lie closely above top plate 274 and closely below bottom plate 276.

As best shown in FIGS. 9 and 10, each reaction roller 238 is tapered in the direction toward its corresponding end connecting plate 280 to match the circumference of the raise hole RH. Each roller 238 is formed with a plurality of hardened circularly extending, V-shaped ridges 292 which dig into the side wall of the raise hole RH when piston rod 256 is extended to thereby prevent the roller from sliding along the circumference of the raise hole while simultaneously permitting the roller to roll along the length of the raise hole. Correspondingly, stabilizer unit 38 is prevented from rotating within, but not from moving longitudinally along, the raise hole together with cutter carrier 21.

Figure 3:
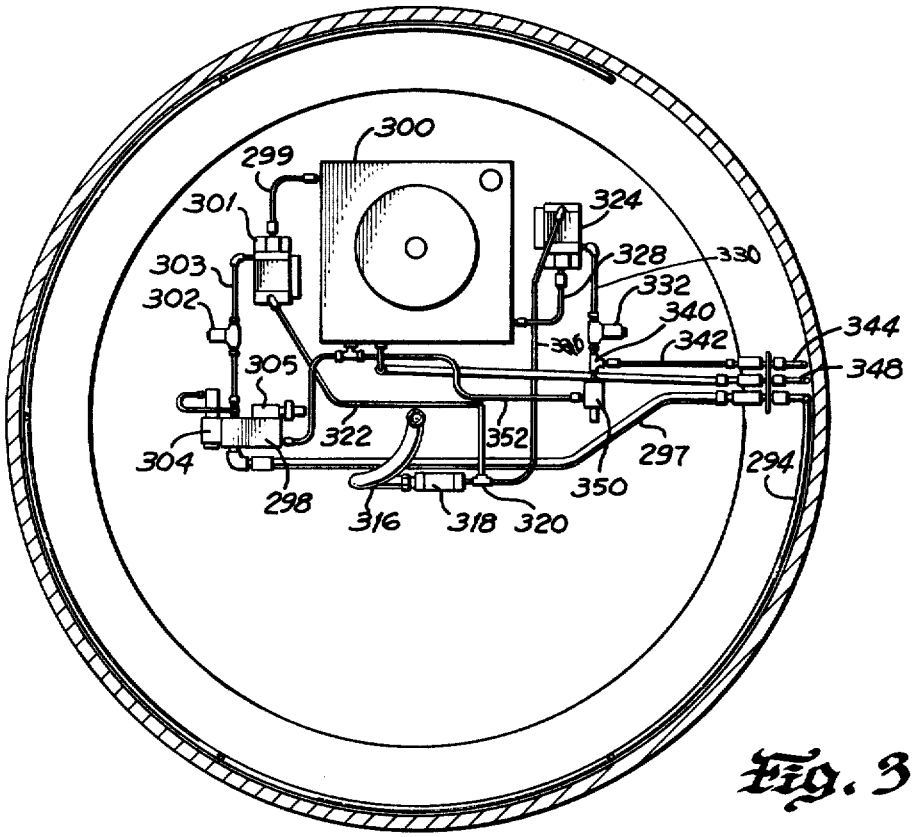
FIG. 3 is a bottom view of the typical embodiment of the present invention illustrated in FIG. 1 depicting the hydraulic supply and lubricating systems.
Figure 11:
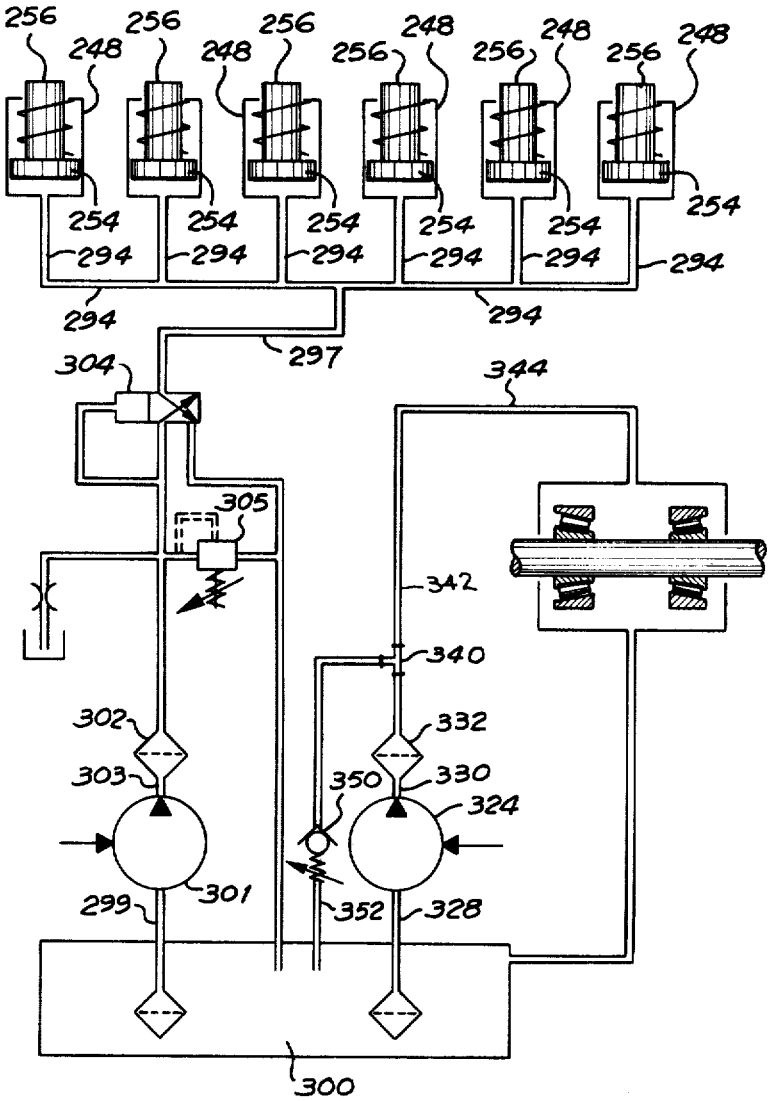
FIG. 11 is a schematic showing of the system for lubricating the step-up drive system, and the system for supplying pressurized hydraulic fluid to the cutter carrier fluid rams.

As best shown in FIGS. 1, 3 and 11, pressurized hydraulic fluid is supplied to each cylinder 248 by line 294 extending downwardly from a fitting 296 threaded into an opening provided in the radially inward closed end of each of said cylinders 248. From fitting 296, line 294 extends downwardly along the inside surface of stabilizer frame wall 240 to ledge 242 and then circumferentially around wall 240 to the outer end of a radially disposed tube 297 leading to a manifold 298 mounted on cover 244. Hydraulic fluid is supplied to manifold 298 through line 299 from a reservoir 300 by an air powered hydraulic pump 301. An oil filter 302 is interconnected between pump 301 and manifold 298 by a supply line 303. A directional flow valve 304 is connected to manifold 298 for directing hydraulic fluid from pump 301 to cylinders 248 when desired to press rollers 238 against the raise hole walls or for directing hydraulic fluid from cylinders 248 to reservoir 300 when desired to retract the rollers. Manifold 298 is also fitted with a pressure relief valve 305 for returning hydraulic fluid to reservoir 300 if the pressure of the hydraulic fluid leading to cylinders 248 exceeds a predetermined level.

Air, under pressure, is supplied to air/hydraulic pump 301 to thereby extend cylinders 248 to drive rollers 238 into raise hole RH from an external source which is typically located at the mine level where the raise drilling machine used to rotate and lift raise bit 18 is located. Thus, when it is desired to have rollers retracted away from raise hole RH, for instance when removing raise bit 18 from the raise hole, the air flowing to pump 301 is simply depressurized. Air from this remote source flows downwardly through the hollow interior of the drill pipe (not shown) depending from the drilling machine and then through the central bore 308 of drill stem 20, FIG. 1. As best shown in FIG. 2, from the lower end of drill stem 20, the pressurized air enters a chamber 309 formed by the lower end of the drill stem, connecting ring center portion 122 and the upper surface of plate 126. An O-ring 310 engages within a radially outwardly open groove provided in the upper rim portion 311 of plate 126 to press against the smooth adjacent inside surface of connecting ring center portion 422 to prevent the pressurized air from leaking out therebetween. Likewise an O-ring 312 is retained in a groove formed within the upper end portion of connecting ring center portion 122 to seal against a machined mating surface of carrier shell floor plate 66 to prevent passage of pressurized air therebetween.

From chamber 309 the pressurized air flows downwardly through an air delivery tube 313, then through a swivel connection 314 and finally through supply line 316 extending from the swivel connection to strainer 318 and adjacently located T-filling 320, FIG. 30. From fitting 320 the air is directed to pump 301 through line 322 and to a second air powered hydraulic pump 324 through line 326. Pump 324 draws hydraulic fluid from reservoir 300 through inlet line 328 and then forces the fluid through outlet line 330, filter 332, Tee-filling 340, delivery line 342 and line assembly 344 to an inlet port formed in the central hub portion 128 of stabilizer frame 130. As best shown in FIGS. 2 and 11, a vertical passage is formed in hub portion 128 which directs the lubricating fluid to the upper side of upper bearing 123. After lubricating bearing 123, the hydraulic fluid cascades downwardly through the lower bearing 124, secondary planetary gear drive 34, primary planetary gear drive 36, and finally through the vertically spaced apart drive shaft bearings 200 and 201. As shown in FIG. 2, a horizontally disposed, tapped drain hole is provided in the lower end portion of drive shaft support collar 202 to receive a fitting 346 at the adjacent end of return line assembly 348 which extends between the support collar and reservoir 300. As best illustrated in FIGS. 3 and 11, a relief valve 350 is connected in fluid flow communication to the side of Tee-fitting 340 opposite filter 332 to direct the lubricating system oil back to reservoir 300 through line 352 if the pressure in the lubricating system exceeds a preselected level.

To utilize the present invention to enlarge a preexisting pilot hole PH formed, for instance, between two levels of a mine, raise drill bit 18 is first connected to the lower end of drill stem 20 which extends downwardly through the preexisting pilot hole from the drilling machine (not shown) located at the upper level of the mine. Cutter carrier 21 can be disassembled from the remainder of raise bit 18 to conveniently transport the bit to the lower level of the mine even through drifts which are very short. This is accomplished by removing bolts 120 which connect connecting ring 118 to the attachment ring portion 119 of cutter carrier frame structure 22 and removing bolts 121 which connect connecting ring lugs 121A to attachment ring portion lugs 121B, FIGS. 1, 2 and 12.

Once transported to the lower level of the mine, cutter carrier 21 is attached to drill stem 20 by first engaging splined insert 50 with the corresponding splined portion 51 of the drill stem and next engaging large nut 52 with the threaded lower end portion 53 of the drill stem. Then, keeper plate 56 is bolted to the lower end of drill stem 20 by capscrews 58 after shims 60 have been inserted between the upper surface of the keeper plate and the bottom of nut 52 to thereby minimize the possibility that nut 52 will loosen. Thereafter, the segments of wedge ring 62 are bolted to the upper end portion of hub section 58 by capscrews 63. Mounting plate 98, which carries central cutters 24, is bolted to the upper surface of shell 64 by capscrews 100, FIG. 13. Then the only remaining step is to assemble cutter carrier 21 with step-up drive 32 by bolting connecting ring 118 to the attachment ring portion 119 of cutter carrier frame structure 22 by capscrews 120 and by securing connecting ring lugs 121A to lugs 121B of attachment ring portion 119 by capscrews 121, FIGS. 1, 2 and 12.

To utilize raise bit 18 to form a raise hole RH, air within stem chamber 308 is pressurized to extend rollers 238, and then drill stem 20 is simultaneously rotated and pulled upwardly by a drilling machine (not shown) located at the upper level of the mine. As bit 18 is so rotated and urged upwardly, roller cutters 24, 26 and 28 disintegrate the earth formation surrounding pilot hole PH to enlarge it to a diameter defined by gage cutters 28. While cutter carrier 21 rotates, it powers secondary and primary planetary gear drives 34 and 36, respectively, which in turn drive flywheel assembly 30 at a significantly greater speed than the rotational speed of the cutter carrier. In most situations the rotational speed of flywheel assembly 30 will be at least an order of magnitude greater than the rotational speed of the cutter carrier. The precise step-up drive ratio used will depend on various factors such as the size of the raise hole being drilled, the mass of the flywheel and the type of rock being drilled through. The rotating flywheel assembly 30 serves as a torque reservoir to supply additional torque load to cutter carrier 21 to keep the cutter carrier rotating at a substantially constant speed even if the cutters suddenly encounter a large additional resisting load from, for instance, a fracture resistant section of rock.

In raise bits which do not utilize a flywheel, such as flywheel assembly 30, the long drill string tends to rotate more slowly or even stop when encountering a hard rock formation, thus causing the drill string to wind up. After sufficient windup energy has been imparted to the twisted drill string to overcome the resistance of the hard rock formation, the bit suddenly breaks loose thereby rapidly unwinding the drill string. Not uncommonly, the bit actually overruns the drill string thus twisting the drill string in advance of the drilling machine. Because all of the energy in the drill string and raise bit has been expended to wind up the drill string in advance of the power source, little if any torque is available to drive the raise bit. Consequently another stoppage of the raise bit often occurs. Moreover, the overrunning raise bit may even cause the threaded segments of the drill string to loosen and uncouple from each other thereby resulting in the destruction of the bit and the attached length of drill pipe from their fall to the bottom of the raise hole.

During operation of raise bit 18, stabilizer unit 38 transfers the reaction torque generated by the planetary gear drives 34 and 36 to the walls of the raise hole RH. Furthermore, the piloting of stabilizer unit 38 within the raise hole RH by torque reaction rollers 230 rolling along the wall of said raise hole stabilizers bit 18 against lateral movement when, for instance, the roller cutters encounter a hard rock formation at one side of pilot hole PH. As a result, a straighter, more uniform raise hole RH is formed.

If for some reason drill stem 20 and cutter carrier 24 suddenly accellerate or decellerate relative to flywheel assembly 30, the flywheel assembly can rotate relative to flywheel drive hub 199 to thereby avoid generating any extreme stress loads in the drive hub or any other component of raise bit 18. Once the preselected frictional force imposed on flywheel plates 213 and 214 by pistons 222 and 223 is overcome by the difference in angular acceleration between flywheel assembly 30 and drive hub 199, the flywheel plates are free to slip relative to flywheel mounting disc 216 to thereby allow the flywheel assembly to continue to rotate at substantially its then current speed. Also, vibration and shock loads acting between drive hub 199 and flywheel assembly 30 are at least partially absorbed by elastomeric rings 220 and 211. The elastomeric rings also permit drive hub 199, and thus cutter carrier 21, to rock or tilt relative to flywheel assembly 30, during the normal reaming process.

To remove raise bit 18 from raise hold RH, the air flowing downwardly through the drill stem is depressurized thereby retracting rollers 238 away from the raise hole walls. Then bit 18 can be simply lowered to the bottom of raise hole RH.

As will be apparent to those skilled in the art to which the invention is addressed, the present invention may be embodied in specific forms and embodiments other than those specifically here disclosed, without departing from the spirit or essential characteristics of the invention. The particular embodiments of the raise bit 18, described above, are therefore to be considered in all respects as illustrative and not restrictive, i.e. the scope of the present invention is as set forth in the appended claims rather than being limited to the examples of raise bit 18 set forth in the foregoing description.

I claim:

1. A rotary drill bit for producing a raise hole by disintegrating the earth formation surrounding a preformed pilot hole, such bit being connectable to a rotary powered drill stem extending through the pilot hole, and comprising:

a cutter carrier frame structure detachably connected to the drill stem to rotate therewith;

central cutter means mounted on said frame structure at a location disposed adjacent the drill stem; and a plurality of intermediate roller cutters:

each having peripheral cutting portions projecting upwardly of said frame structure to sweep concentric circles about the longitudinal axis of the drill stem upon rotation of said frame structure; and being mounted on said frame structure at locations outwardly of said center cutter means in specific angular relationship to each other to define a cutting profile with the concentric circles swept by the peripheral portions of said intermediate roller cutters in the form of a segment of a spiral extending radially outwardly and downwardly from the center cutter means in a decreasing curvature, said cutting profile being established by angularly orientating said intermediate roller cutters relative to each other to decrease progressively the angle separating the two adjacent chords corresponding to a set of any three adjacent cutting profile circles of any three radially adjacent intermediate roller cutters as the radial location of said intermediate roller cutters from the longitudinal axis of the drill stem increases.

2. A rotary drill bit according to claim 1, wherein within a set of three adjacent chords corresponding to any four adjacent circles swept by said intermediate cutters, the angle separating the two chords of the set located radially inwardly nearer the drill stem is from one to forty percent greater than the angle separating the two chords of the set located radially outwardly further from the drill stem.

3. A rotary drill bit according to claim 2, wherein the angle separating the two adjacent chords corresponding to a set of any three adjacent cutting profile circles progressively decreases at a constant rate.

4. A rotary drill bit according to claims 1 or 2, wherein the chordal distance separating the adjacent circles swept by any two radially adjacent intermediate cutters is constant.

5. A rotary drill bit according to claim 1, wherein said central cutter means includes at least one central roller cutter adapted to rotate about an axis of rotation extending generally perpendicular to the longitudinal axis of the drill stem to disintegrate the earth formation adjacent the drill stem.

6. A rotary drill bit according to claim 1, wherein said cutter carrier frame structure includes a hollow, generally dome-shaped shell generally corresponding to the shape of the cutting profile defined by the circles swept by said intermediate cutters, said central cutter means and said intermediate roller cutters being mounted on said shell to extend upwardly therefrom.

7. A rotary drill bit according to claim 6, wherein said cutter carrier frame structure includes portions defining a plurality of material passageways extending downwardly through said frame assembly for passing earth material disintegrated by said intermediate roller cutters through said frame assembly to fall down through the raise hole.

8. A rotary drill bit according to claim 1, further comprising a plurality of roller gage cutters mounted on said cutter carrier frame structure at locations radially outwardly of said intermediate roller cutters to form the outer diameter of the raise hole, each of said gage cutters having peripheral cutting portions extending upwardly and radially outwardly of said frame structure, said gage cutter peripheral cutting edges upon rotation of said cutter carrier frame structure defining a cutting profile at least initially extending tangentially outwardly from the cutting profile defined by the peripheral cutting portions of said intermediate roller cutters.

9. A rotary drill bit according to claim 8, wherein the cutting profile defined by said gage cutters curves downwardly after initially extending tangentially outwardly from the cutting profile defined by the peripheral cutting portions of said intermediate roller cutters to form the outer diameter of the raise hole.

10. A rotary drill bit for producing a raise hole by disintegrating the earth formation surrounding a preformed pilot hole, such bit being connectible to a rotatably powered drill stem extending through the pilot hole, and comprising:

a cutter carrier frame structure detachably connectible to the drill stem to rotate therewith;

central cutter means mounted on said frame structure at a location disposed adjacent the drill stem;

a plurality of intermediate roller cutters mounted on said frame structure at locations outwardly of said central cutter means, said intermediate roller cutters having peripheral cutting portions projecting upwardly of said frame structure to sweep concentric circles about the longitudinal axis of the drill stem upon rotation of said frame structure, with said intermediate roller cutters arranged on said frame structure so that the profile of the circles swept by said intermediate roller cutters collectively defining a cutting profile on each side of the longitudinal axis of the drill stem in the form of a portion of a spiral, which profile curves radially outwrdly and downwardly from said central cutter means, with the angle separating the two adjacent chords corresponding to a set of any three adjacent cutting profile circles progressively decreasing as the radial distance between said intermediate cutters and the longitudinal axis of the drill stem increases;

a flywheel assembly;

step-up means interconnecting the cutter carrier frame structure to said flywheel assembly for driving said flywheel assembly at a speed at least one order of magnitude faster than the rotational speed of said cutter carrier frame structure; and stabilizer means journaled with said cutter carrier frame structure to transmit reaction torque generated by said step-up means to the wall of the larger diameter raise hole.

11. A rotary drill bit according to claim 10, wherein said step-up means includes a first planetary gear drive having a planetary gear cage connected to said cutter carrier frame structure and driven by the drill stem, a ring gear anti-rotationally coupled to said stabilizer means, and a sun gear coupled to said flywheel assembly.

12. A rotary drill bit according to claim 11, wherein said step-up means further includes a second planetary gear drive having a planetary gear cage connected to the sun gear of said first planetary gear drive, a ring gear anti-rotationally connected to said stabilizer means, and a sun gear coupled to said flywheel assembly.

13. A rotary drill bit according to claim 10, wherein said stabilizer means includes:

a stabilizer frame journaled concentrically with and positioned to trail behind said cutter carrier frame structure within the larger diameter raise hole;

means carried by said stabilizer frame for engaging with the wall of the larger diameter raise hole for maintaining said stabilizer frame against rotation; and means interconnecting said stabilizer frame and said step-up means to transfer reaction torque generated by said step-up means to said stabilizer frame.

14. A rotary drill bit according to claim 13, wherein the means carried by said stabilizer frame for engaging the wall of the larger diameter hole comprises:

a plurality of extend-retract members extendable radially outwardly from the longitudinal axis of the drill stem;

guide roller means axled to the free end of each extend-retract member to roll longitudinally along the length of the larger diameter hole to permit said stabilizer frame to travel through the larger diameter hole while preventing substantial rotation of said stabilizer frame about the longitudinal axis of the drill stem; and control means to selectively extend and retract said extend-retract members.

15. A rotary drill bit according to claim 10, further comprising vibration and shock absorbing means interconnected between said step-up means and said flywheel assembly to absorb vibration and shock loads acting therebetween.

16. A rotary bit according to claim 10, further comprising adjustable means for mounting said flywheel assembly on said step-up means to enable said flywheel assembly to rotate relative to said step-up means when a preselected difference in angular acceleration occurs between said cutter carrier frame structure and said flywheel assembly.

17. A rotary bit for forming a hole in the earth, said bit being connectible to a rotary power source to rotate the bit about a center and simultaneously advance the bit upwardly through the earth to form the hole, said bit comprising:

a cutter carrier frame structure;

means for connecting said cutter carrier frame structure to the power source to rotate said frame structure about the bit rotational center; and a plurality of roller cutters mounted on said frame structure and having peripheral cutting edge portions extending upwardly of said cutter carrier structure to define, upon rotation of said frame structure, an arcuate cutting profile extending radially outwardly and downwardly from the bit rotational center at a decreasing curvature, said arcuate cutting profile being established by tilting radially adjacent roller cutters relative to each other to increase the angle of tilt of the roller cutter axles as the location of the roller cutters from the bit rotational center increases while simultaneously decreasing the relative angle of tilt between the rotational axles of radially adjacent roller cutters as the location of said roller cutters from the rotational center of the bit increases.

18. A rotary bit according to claim 17, wherein the relative angle of tilt between the rotational axes of radially adjacent cutters decreases at a constant rate.

19. A rotary bit according to claim 17, wherein said cutter carrier frame structure includes a plurality of material passing openings extending downwardly therethrough to allow the earth material disintegrated by said roller cutters to pass downwardly through said cutter carrier frame structure.

20. A rotary bit according to claim 17, wherein said cutter carrier frame structure includes an upper mounting surface formed in a shape generally corresponding to the profile defined by the peripheral cutting edges of said roller cutters, said roller cutters mounted on said upper mounting surface to extend upwardly therefrom.

21. A rotary bit according to claim 17, further comprising a plurality of roller gage cutters mounted on said cutter carrier frame structure at locations outwardly of said roller cutters, said roller gate cutters having peripheral cutting edge portions defining a profile generally corresponding to the profile defined by the cutting edge portions of said intermediate roller cutters.

22. In a rock cutting bit for upreaming a pre-existing pilot hole to form a larger diameter hole, including a rotary cutter carrier connectible to the lower end portion of a rotary drill stem suspended from a rotary drilling machine located above the pilot hole, and rock cutting means carried by the cutter carrier and adapted to cut the rock formation surrounding the pilot hole during rotation of the cutter carrier by the drill stem, the improvement comprising:

a flywheel assembly;

step-up means drivingly interconnecting the cutter carrier to said flywheel assembly to that rotational drive applied to the cutter carrier by the drill stem drives said flywheel assembly at a rotational speed at least an order of magnitude faster than the rotational speed of the cutter carrier; and stabilizer means for transmitting reaction torque generated by said step-up means to the wall of the larger diameter hole.

23. The improvement according to claim 22, wherein said stabilizer means includes:

a stabilizer frame journaled with, and positioned to trail behind, the cutter carrier in the larger diameter hole;

means carried by said stabilizer frame for engaging with the wall of the larger diameter hole for maintaining said stabilizer frame against rotation; and means interconnecting said stabilizer frame and said step-up means to transfer reaction torque generated by said step-up means to said stabilizer frame.

24. The improvement according to claim 23, wherein said means carried by said stabilizer frame for engaging the wall of the larger diameter hole comprises:

a plurality of fluid rams extendable radially outwardly of the rotational axis of the cutter carrier, and guide roller means rotationally mounted to the free end of each of said rams to roll longitudinally along the larger diameter hole to permit said stabilizer frame to travel through said larger diameter hole while substantially preventing rotation of said stabilizer frame about the rotational axis of the cutter carrier.

25. The improvement according to claim 22, wherein said step-up means further comprises a first planetary gear drive having a planetary gear cage connected to the cutter carrier and driven by the drill stem, a ring gear fixedly attached to said stabilizer means, and a sun gear coupled to said flywheel assembly.

26. The improvement according to claim 25, wherein said step-up means further comprises a second planetary gear drive having a planetary gear cage connected to the sun gear of said first planetary gear drive, a ring gear fixedly attached to said stabilizer means, and a sun gear coupled to said flywheel assembly.

27. The improvement according to claim 22, further comprising vibration and shock absorbing means interconnected between said step-up means and said flywheel assembly to absorb vibration and shock loads acting therebetween.

28. The improvement according to claim 22, further comprising selectively adjustable mounting means for mounting said flywheel assembly on said step-up means to enable said flywheel assembly to rotate relative to said step-up means when a preselected difference in angular acceleration occurs between the cutter carrier and said flywheel assembly.

29. The improvement according to claim 28, wherein:

said flywheel mounting means comprises a mounting disc driven by said step-up means at such increased speed;

said flywheel assembly includes annularly shaped upper and lower rim sections clamped together to overlap the upper and lower faces of said mounted disc such that said flywheel rim sections are capable of rotating relative to said mounting disc; and further including thrust means for frictionally bearing against said upper and lower flywheel rim sections to nominally rotatably lock said flywheel assembly to said flywheel mounting disc while permitting relative rotation between said flywheel assembly and said flywheel mounting disc when a predetermined differential in angular acceleration exists therebetween.

30. The improvement according to claim 29, wherein said thrust means includes:

a plurality of pistons housed within said flywheel mounting means mounting disc to push against adjacent portions of said upper and lower flywheel rim sections; and fluid supply means for driving said pistons against said upper and lower flywheel rim sections, said fluid supply means including regulator means for selectively controlling the pressure of such pressurized fluid.

31. The improvement according to claims 28 or 29, further comprising shock absorbing means disposed between said step-up means and said flywheel assembly to absorb impact loads acting therebetween.

32. The improvement according to claim 31, wherein:

said step-up means includes a circular drive plate section driven at stepped-up speed by said step-up means;

said flywheel mounting means further includes a clamping ring securable to said drive plate section to clamp said flywheel mounting disc to said drive plate section;

a first elastomeric ring disposed between said step-up means drive plate section and one face of said flywheel mounting disc; and a second elastomeric ring disposed between said flywheel clamping ring and the opposite face of said flywheel mounting disc.

33. The improvement according to claim 22, wherein the rock cutting means includes a plurality of roller cutters having the peripheral cutting edge portions, said roller cutters mounted on the cutter carrier so that upon rotation of the cutter carrier by the drill stem, the peripheral cutting edge portions of said roller cutters collectively define a cutting profile in the form of a portion of a spiral curve, said cutting profile arcing radially outwardly and downwardly from the central upper portion of the cutter carrier, with the slope of the cutting profile increasing at a decreasing rate as the radial distance of said roller cutters from the rotational axis of the cutter carrier increases.

34. The improvement according to claim 33, wherein the slope of the cutting profile generated by the peripheral cutting edge portions of said roller cutters increases at a uniformly decreasing rate as the radial distance between said roller cutters and the rotational axis of the cutter carrier increases.

35. The improvement according to claim 33, wherein the cutter carrier includes a frame structure having a central hub for receiving the lower end portion of the drill stem; a generally dome-shaped cutter mounting shell surrounding said central hub and shaped generally corresponding to the profile generated by said roller cutter peripheral cutting edge portions, said roller cutters mounted on said shell to extend upwardly therefrom, a floor substantially closing off the bottom of said shell; and a plurality of material passing passageways extending downwardly through said frame structure to permit rock cut by said roller cutters to pass downwardly through said frame structure.

36. A rotary drill bit connectible to a rotary drill stem for upreaming a pre-existing pilot hole to form a larger diameter hole by cutting the rock formations surrounding the pilot hole during rotation of the drill stem, said drill bit comprising:

a cutter carrier frame structure connectible to the drill stem to rotate therewith;

a plurality of roller cutters mounted on said frame structure, said roller cutters having peripheral cutting edges extending upwardly of said frame structure for cutting concentric kerfs about the rotational center of said frame structure upon rotation of the drill stem, with the cutting edges of at least a portion of said roller cutters defining a segment of a downwardly convex, generally spiral shaped profile which decreases in curvature as the radial distance separating said roller cutters from the drill stem increases;

a flywheel assembly journaled with said cutter carrier frame structure;

step-up means interconnecting said cutter carrier frame structure and said flywheel assembly for driving said flywheel assembly at a speed at least one order of magnitude faster than the rotational speed of said cutter carrier frame structure; and stabilizer means journaled with said cutter carrier frame structure to transmit reaction torque generated by said step-up means to the wall of the larger diameter holes.

37. A rock drilling bit according to claim 36, wherein said cutter carrier frame structure includes:

a cutter mounting shell formed generally in the shape of the profile defined by the peripheral cutting edges of said roller cutters, said roller cutters mounted on said shell to extend upwardly therefrom; and having portions defining material passing passageways extending through said shell for passing rock cut by said roller cutters downwardly through said frame structure.

38. A rotary drill bit according to claim 36, further comprising central cutter means detachably mounted on said frame structure adjacent the drill stem, said central cutter means including:

a generally flat mounting plate partially encircling said drill stem; and at least one central roller cutter mounted on said mounting plate at a location closely adjacent the drill stem to cut a concentric kerf about the rotational center of the frame structure upon rotation of the drill stem to disintegrate the portion of the rock formation adjacent the pilot hole.

39. A rotary drill bit according to claim 36, further comprising a plurality of roller gage cutters mounted on said cutter carrier frame structure at locations radially outwardly of said roller cutters to form the outer circumference of the larger diameter hole, each of said gage cutters having peripheral cutting edge portions extending tangentially to the profile defined by the cutting edge portions of said roller cutters.

40. A rotary drill bit according to claim 36, wherein said stabilizer means includes:

a stabilizer frame journaled with, and positioned to trail behind, the cutter carrier frame structure in the larger diameter hole;

means carried by said stabilizer frame for selectively engaging and disengaging with the wall of the larger diameter hole for maintaining said stabilizer frame against rotation; and means interconnecting said stabilizer frame and said step-up means to transfer reaction torque generated by said step-up means to said stabilizer frame.

41. A rotary drill bit according to claim 40, wherein said means carried by said stabilizer frame for engaging the wall of the larger diameter hole comprises:

a plurality of fluid rams extendable radially outwardly from the rotational center of the cutter carrier frame structure; and guide roller means rotationally mounted on the free end of each of said rams to roll longitudinally along the length of the larger diameter hole to permit said stabilizer frame to travel through said large diameter hole while substantially preventing rotation of said stabilizer frame about the rotational center of said cutter carrier frame structure.

42. A rotary drill bit according to claim 36, wherein said step-up means further comprises a first planetary gear drive having planetary gear cage connected to the cutter carrier frame structure and driven by the drill stem, a ring gear fixedly attached to said stabilizer means, and a sun gear coupled to said flywheel assembly.

43. A rotary drill bit according to claim 42, wherein said step-up means further comprises a second planetary gear drive having a planetary gear cage connected to the sun gear of said first planetary gear drive, a ring gear fixedly attached to said stabilizer means, and a sun gear coupled to said flywheel assembly.

44. A rotary drill bit according to claim 43, further comprising vibration and shock absorbing means interconnected between said step-up means and said flywheel assembly to at least partially absorb vibration and shock loads acting therebetween.

45. A rotary drill bit according to claim 44, wherein:

said step-up means includes a circular drive plate section driven at increased speed by said step-up means;

further comprising flywheel mounting means including a mounting disc driven by said step-up means;

a clamping ring securable to said drive plate section to clamp said flywheel mounting disc to said drive plate section;

a first elastomeric ring disposed between said step-up means drive plate section and one face of said flywheel mounting disc; and a second elastomeric ring disposed between said flywheel clamping ring and the opposite face of said flywheel mounting disc.

46. A rotary drill bit according to claim 45, further comprising selectively adjustable mounting means for mounting said flywheel assembly to rotate relative to said step-up means when a preselected difference in angular acceleration occurs between said cutter carrier frame structure and said flywheel assembly.

47. A rotary drill bit according to claim 46, wherein:

said flywheel mounting means comprises a mounting disc driven by said step-up means at increased speed;

said flywheel assembly includes angularly shaped upper and lower rim sections clamped together to overlap the upper and lower faces of said mounting disc such that said flywheel rim sections are capable of rotating relative to said mounting disc; and further includes:

thrust means for frictionally bearing against said upper and lower flywheel rim sections to nominally rotatably lock said flywheel assembly to said flywheel mounting disc while permitting relative rotation between said flywheel assembly and said flywheel mounting disc when a predetermined differential in angular acceleration exists therebetween.

48. The improvement according to claim 47, wherein said thrust means includes:

a plurality of pistons housed within said flywheel mounting means mounting disc to push against adjacent portions of said upper and lower flywheel rim sections; and fluid supply means for directing pressurized fluid against the back side of said pistons opposite said corresponding flywheel rim sections, said fluid supply means including regulator means for selectively controlling the pressure of such pressurized fluid.

* * * * *